US006249249B1

(12) United States Patent
Obayashi et al.

(10) Patent No.: US 6,249,249 B1
(45) Date of Patent: Jun. 19, 2001

(54) ACTIVE ARRAY ANTENNA SYSTEM

(75) Inventors: Shuichi Obayashi; Takafumi Yamaji; Shoji Otaka, all of Yokohama; Hiroki Shoki, Kawasaki; Yasushi Murakami, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/310,198

(22) Filed: May 12, 1999

(30) Foreign Application Priority Data

May 14, 1998 (JP) ..... 10-131982

(51) Int. Cl.[7] ..... H01Q 3/22
(52) U.S. Cl. ..... 342/371; 342/372
(58) Field of Search ..... 342/371, 372, 342/368, 382, 92, 392

(56) References Cited

U.S. PATENT DOCUMENTS

| | | | | |
|---|---|---|---|---|
| 4,079,318 | * | 3/1978 | Kinoshita | 325/305 |
| 4,261,056 | * | 4/1981 | Barnett et al. | 455/273 |
| 4,354,276 | * | 10/1982 | Karabinis | 455/139 |
| 4,736,455 | * | 4/1988 | Matsue et al. | 455/138 |
| 5,046,133 | * | 9/1991 | Watanabe et al. | 455/138 |
| 5,513,222 | * | 4/1996 | Iwasaki | 373/347 |
| 5,568,158 | * | 10/1996 | Gould | 343/756 |

FOREIGN PATENT DOCUMENTS

| | | |
|---|---|---|
| 0 573 247 A1 | 12/1993 | (EP) . |
| 3-001712 | 1/1991 | (JP) . |
| 3-136404 | 6/1991 | (JP) . |
| 7-202548 | 8/1995 | (JP) . |

OTHER PUBLICATIONS

European Search Report for European Patent Application No. 99 30 3787, dated Aug. 24, 1999.

* cited by examiner

*Primary Examiner*—Dao Phan
(74) *Attorney, Agent, or Firm*—Finnegan, Henderson, Farabow, Garrett, & Dunner L.L.P.

(57) ABSTRACT

An active array antenna system comprises a plurality of element antennas and radio frequency circuits connected to the element antennas. The radio frequency circuits comprises first frequency converters provided to correspond to the element antenna and converts the frequency between a carrier-wave frequency and a first intermediate-frequency by using a carrier-wave frequency band local signal, second frequency converters provided to correspond to the element antenna and converts the frequency between the first intermediate-frequency signal and a second intermediate-frequency which is lower than the first intermediate frequency by using an intermediate-frequency band local signal, and a variable phase shifter circuit for individually controlling the phases of the intermediate-frequency local signals which are supplied to the second frequency converters. A variable phase shifter circuit for beam scan can be constituted at a low cost so that an active array antenna system which can be realized at a low cost is provided.

18 Claims, 22 Drawing Sheets

ACTIVE ARRAY ANTENNA SYSTEM

BACKGROUND OF THE INVENTION

The present invention relates to an active array antenna system for use in wireless communication and comprising a plurality of element antennas and radio frequency circuits, and more particularly to a variable phase shifter circuit for controlling the phase of a local signal which is supplied to a frequency converting circuit in the radio frequency circuit.

This application is based on Japanese Patent Application No. 10-131982, filed May 14, 1998, the content of which is comprised herein by reference.

In general, the active array antenna system comprises a plurality of element antennas and radio frequency circuits connected to the element antennas. The active array antenna system is an antenna system for imparting an appropriate phase difference or the phase difference and an appropriate gain difference to a received RF signal or an RF signal to be transmitted, of each element antenna. Thus, directional beam scan can be performed or an arbitrary directional beam can be realized.

A conventional beam scan method adapted to the active array antenna system has been disclosed in Japanese Patent Laid-Open No. 7-202548 (hereinafter techniques described in this disclosure are called "conventional techniques"). According to the disclosure, a variable phase shifter circuit is provided for imparting a predetermined phase difference to a local signal in a carrier-wave frequency band which is supplied to each of frequency converting circuits corresponding to the plural element antennas. Since the S/N ratio of the local signal in the carrier-wave frequency band is higher than that of the received RF signal, the conventional technique attains the following advantages:

(1) An influence of deterioration in the S/N ratio caused by the variable phase shifter circuit on the RF signal can be limited as compared with a case where the variable phase shifter circuit is provided for a signal line for the RF signal.

(2) A plurality of variable phase shifters can concentrically be disposed.

(3) The structure of the control system can be simplified.

When the foregoing conventional technique is applied to a wireless communication system which uses a high carrier-wave frequency, such as a microwave or a millimeter wave, the foregoing conventional technique, however, encounters the following problem. That is, the cost of the variable phase shifter circuit for the local signal in the carrier-wave frequency band cannot be reduced. As a result, the overall cost of the active array antenna system cannot be reduced.

According to the conventional technique, the carrier-wave frequency is fixed. When the conventional technique is used to receive or transmit a plurality of carrier-wave frequencies by a single active array antenna system, such as the FDMA system or a multi-carrier TDMA system, there is a disadvantage that the structure of a power supply system becomes complex.

The conventional technique employs a filter or a delay element (for example, a delay line) to serve as the variable phase shifter circuit for the local signal in the carrier-wave frequency band. If the phase shift variation function is provided for the filter or the delay element, the cost cannot be reduced or a variable range for the phase shift is limited in general. As a result, beam scan freedom is narrowed.

As described above, the conventional active array antenna system has the structure that the phase of the local signal in the carrier-wave frequency band for the beam scan is controlled by the variable phase shifter circuit. When the conventional active array antenna system is applied to a wireless communication system using a high carrier-wave frequency, the cost of the variable phase shifter circuit cannot however be reduced. Thus, there arises a problem in that the cost of the active array antenna system cannot be reduced. Since the carrier-wave frequency is fixed, a plurality of carrier-wave frequencies cannot easily be transmitted or received by a single active array antenna system. Since the filter or the delay element is employed as the variable phase shifter circuit, the variable range of the phase shift is limited. As a result, there arises a problem in that beam scan freedom is narrowed.

BRIEF SUMMARY OF THE INVENTION

Accordingly, it is an object of the present invention to provide an active array antenna system which is capable of constituting a variable phase shifter circuit for performing beam scan with a low cost and thus realizing the overall system with a low cost.

Another object of the present invention is to provide an active array antenna system which exhibits a wide variable range for the phase shift and which is capable of widening the beam scan freedom.

Another object of the present invention is to provide an active array antenna system which can be used in a communication using a plurality of carrier-wave frequencies without a necessity of employing a complicated power supply system and which is advantageous when an FDMA system or a multi-carrier TDMA system is constituted.

According to the present invention, there is provided an active array antenna system comprising a plurality of element antennas; and radio frequency circuits connected to the plural element antennas and comprising a frequency converting circuit provided for each element antenna and performing a frequency conversion by using an intermediate-frequency band local signal, and a variable phase shifter circuit for controlling phases of the intermediate-frequency band local signals which are supplied to the frequency converting circuits.

The frequency converting circuit comprises a plurality of first frequency converters provided to correspond to the element antennas and converting the frequency between a carrier-wave frequency and the first intermediate-frequency by using a carrier-wave frequency band local signal, and a plurality of second frequency converters provided to correspond to the element antennas and converting the frequency between the first intermediate-frequency and a second intermediate-frequency which is lower than the first intermediate-frequency by using the intermediate-frequency band local signal.

The variable phase shifter circuit comprises a plurality of variable phase shifters for controlling the phases of the intermediate-frequency band local signals which are supplied to the second frequency converters.

According to the present invention, there is provided another active array antenna system comprising a plurality of element antennas; and radio frequency circuits connected to the plural element antennas and comprising a frequency converting circuit provided to correspond to each of the antennas and performing a frequency conversion between a carrier-wave frequency and an intermediate frequency, and a variable phase shifter circuit provided to correspond to each of the antennas and controlling a phase of a received signal or a transmission signal of each of the antennas, the variable phase shifter circuit having a quadrature modulator.

According to the present invention, there is provided a further active array antenna system comprising a plurality of transmission and reception element antennas; a reception radio frequency circuit supplied with a received signal from the transmission and reception element antenna; and a transmission radio frequency circuit for supplying a transmission signal to the transmission and reception element antenna, wherein the transmission and reception radio frequency circuits comprise a frequency converting circuit provided to correspond to each of the antennas and performing a frequency conversion by using an intermediate frequency band local signal, and a variable phase shifter circuit for controlling a phase of the local signal which is supplied to the frequency converting circuit.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are comprised in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

A preferred embodiment of an active array antenna system according to the present invention will now be described with reference to the accompanying drawings.

First Embodiment

Figure 1:
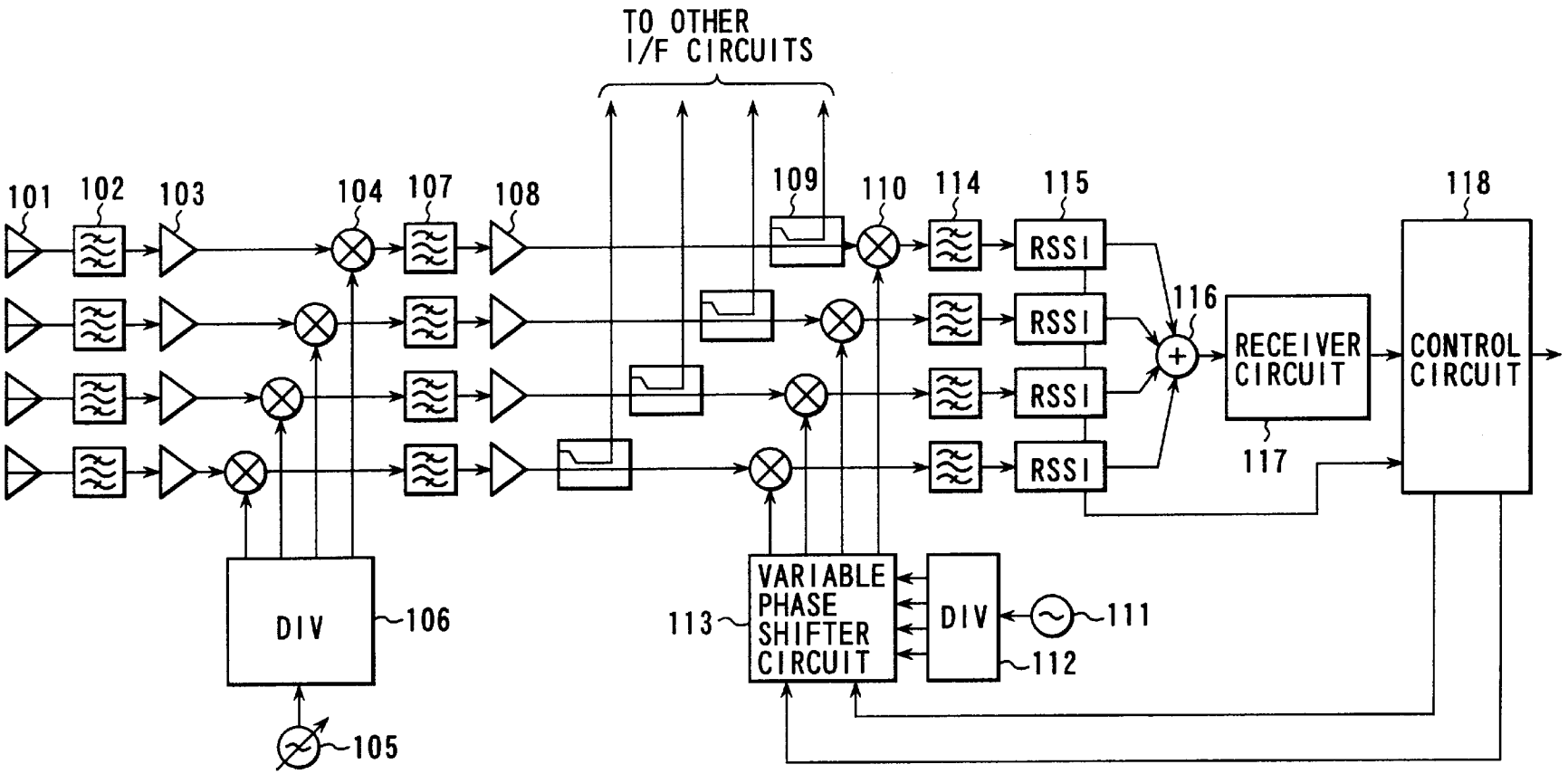
FIG. 1 is a block diagram showing a first embodiment of an active array antenna system according to the present invention.

FIG. 1 is a diagram showing a first embodiment of the active array antenna system according to the present invention. In the following description, an active array antenna system structured as a reception antenna system will be described as an example. Also a transmission antenna can be realized by a similar structure except for the structure that the direction of the flow of RF signals (waves) is inverted. Therefore, the present invention may be structured as a transmission antenna system as described later.

Each of element antennas 101 constituting the array antenna system is an antenna element or an array element composed of a plurality of antenna elements called sub arrays. The element antennas 101 are arranged in a predetermined configuration. In this case, plural (four in this embodiment) element antennas 101 are disposed in line. A radio frequency circuit described later is connected to the element antenna 101. Note that the arrangement of the element antennas are not limited to the straight line. The present invention may be applied to a two dimensional array antenna system having the element antennas disposed to form a square arrangement or a triangular arrangement on a two dimensional plane.

An RF signal received by the element antenna 101 is supplied to an RF filter 102 so that a noise component deviated from a desired frequency band is removed. Then, the RF signal is amplified by a low-noise amplifier (LNA) 103, and then the frequency of the RF signal is converted from a carrier-wave frequency to a first intermediate-frequency. A local signal (hereinafter called a "carrier-wave frequency local signal") in the carrier-wave frequency band is supplied from a local signal generator 105 to the first frequency converter 104 through a divider 106.

When the local signal generator 105 comprises, for example, a synthesizer to make the frequency of the local signal to be variable, the first intermediate-frequency can be fixed if switching among a plurality of frequency channels must be performed. When the first intermediate-frequency is fixed, a noise component deviated from a required channel is removed by a band pass filter 107. Moreover, the amplifier 108 amplifies only the first intermediate-frequency signal.

When the radio frequency circuit from the element antenna 101 to the amplifier 108 is shared among a plurality of intermediate frequency circuits when a quadrature beam is formed, a signal sharing circuit, such as a coupler 109, is provided to share the output signal from the amplifier 108 with another intermediate-frequency circuit. The coupler 109 may be replaced with another circuit element having a signal dividing function, such as an electric power divider.

The first intermediate-frequency signal passed through the coupler 109 is supplied to a second frequency converter 110. Thus, the second frequency converter 110 converts the frequency from the first intermediate-frequency signal to the second intermediate-frequency. The second frequency converter 110 is supplied with a local signal in an intermediate-frequency band (hereinafter called an "intermediate-frequency local signal") from a local signal generator 111 through a divider 112 and a variable phase shifter circuit 113. The variable phase shifter circuit 113 is a circuit for shifting the phase of the intermediate-frequency local signal divided by the divider 112 to output the intermediate-frequency local signal. The specific structure of the variable phase shifter circuit 113 will be described later. The second intermediate-frequency signal output from the second frequency converter 110 is supplied to the band pass filter 114 so that only a predetermined frequency component is fetched.

To simplify the description, an assumption is made that the first intermediate-frequency signal is in the form of a sine wave expressed as $A\cos(\omega_I t+\theta)$, the intermediate-frequency local signal imparted with a required phase shift $\phi$ is a sine wave expressed as $B\cos(\omega_{LO} t+\phi)$. In this case, an output from the second frequency converters 110 is expressed as follows:

$$AB\cos(\omega_I t+\theta)\cos(\omega_{LO} t+\phi)=(AB/2)\times\{\cos((\omega_I-\omega_{LO})t+\theta-\phi)+\cos((\omega_I+\omega_{LO})t+\theta+\phi)\} \quad (1)$$

Note that the second frequency converter 110 has an ideal multiplication characteristic. Since two right-hand terms have different frequencies, extraction of only the first term by the band pass filter 114 enables second intermediate-frequency having the phase shifted from the original phase by $-\phi$ to be obtained.

The level of the obtained second intermediate-frequency signals corresponding to the element antennas 101 is measured by the RSSI circuit 115. Moreover, the second intermediate-frequency signals are added to one another by the adder 116, and then demodulated and detected by a receiver circuit 117. A result of the measurement communicated from the RSSI circuit 115 and demodulated and detected output are supplied to a control circuit 118. The control circuit 118 controls the phase shift of the variable phase shifter circuit 113. Moreover, a received signal is extracted.

Figure 2:
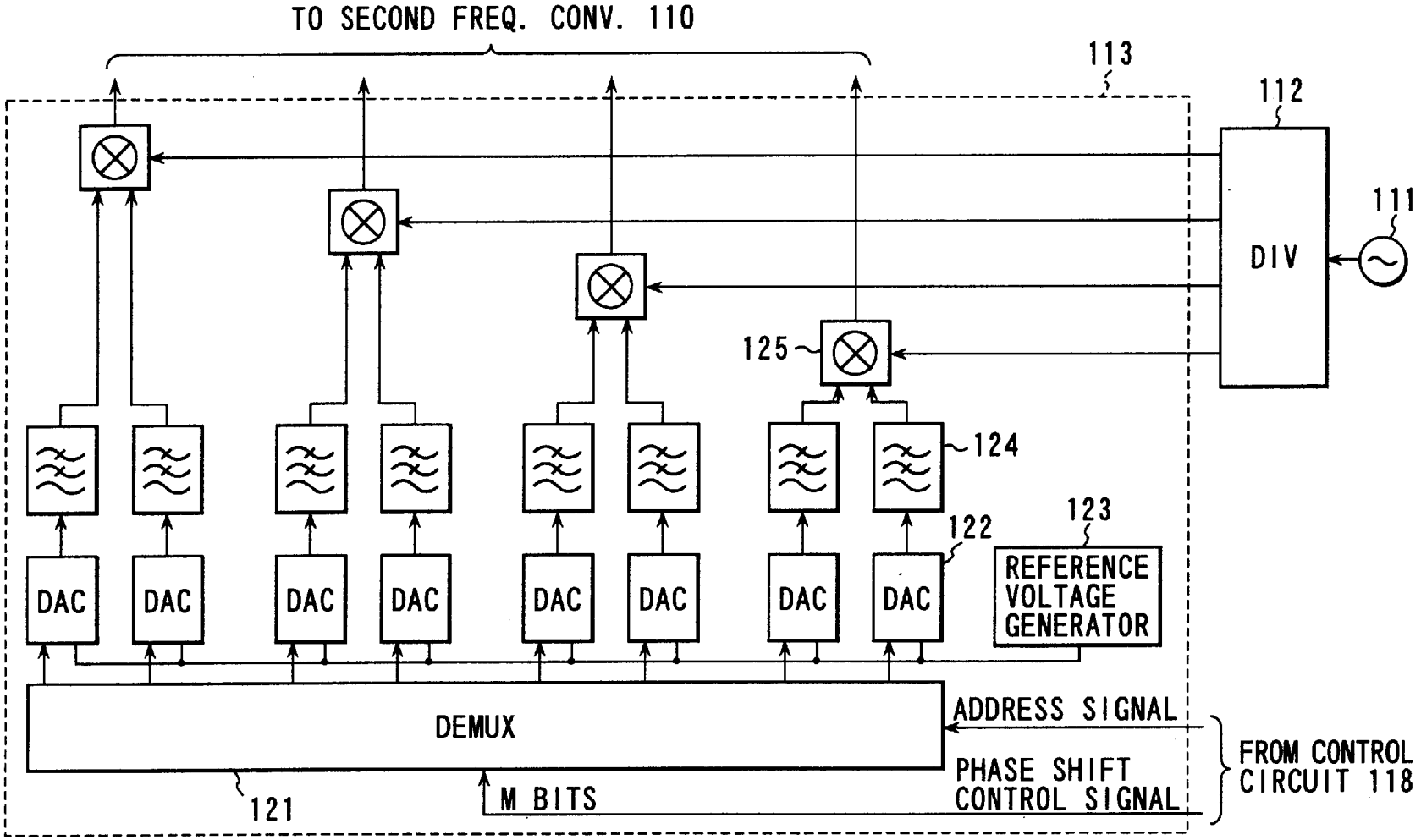
FIG. 2 is a circuit diagram showing a variable phase shifter circuit according to the first embodiment.

FIG. 2 shows an example of the specific structure of the variable phase shifter circuit 113. The variable phase shifter circuit 113 comprises a demultiplexer (DEMUX) 121, a plurality of D/A converters (DAC) 122, a reference voltage generator 123 for generating a reference voltage which is supplied to the plural D/A converter 122, a low pass filter 124 connected to the output of each of the D/A converter 122 and a quadrature modulator 125. The quadrature modulator 125 enables the phase shift to be varied in a range of 360°.

The quadrature modulator 125 has an input for the local signal and inputs for phase shift control signals for channels I and Q. The number of the quadrature modulators 125 is the same as number N of the element antennas (which is the same as the number of the second frequency converters 110). The D/A converters 122 and the low pass filters 124 are provided by 2N so as to supply phase shift control signals of the channels I and Q to the inputs of the quadrature modulator 125 for receiving the phase shift control signals. The quadrature modulator 125 shifts the phase of the carrier-wave frequency local signal supplied from the local signal generator 111 through the divider 112 in accordance with the phase shift control signal of each of the I and Q channels so as to supply the local signal to the input of the second frequency converter 110 for receiving the local signal.

Figure 3:
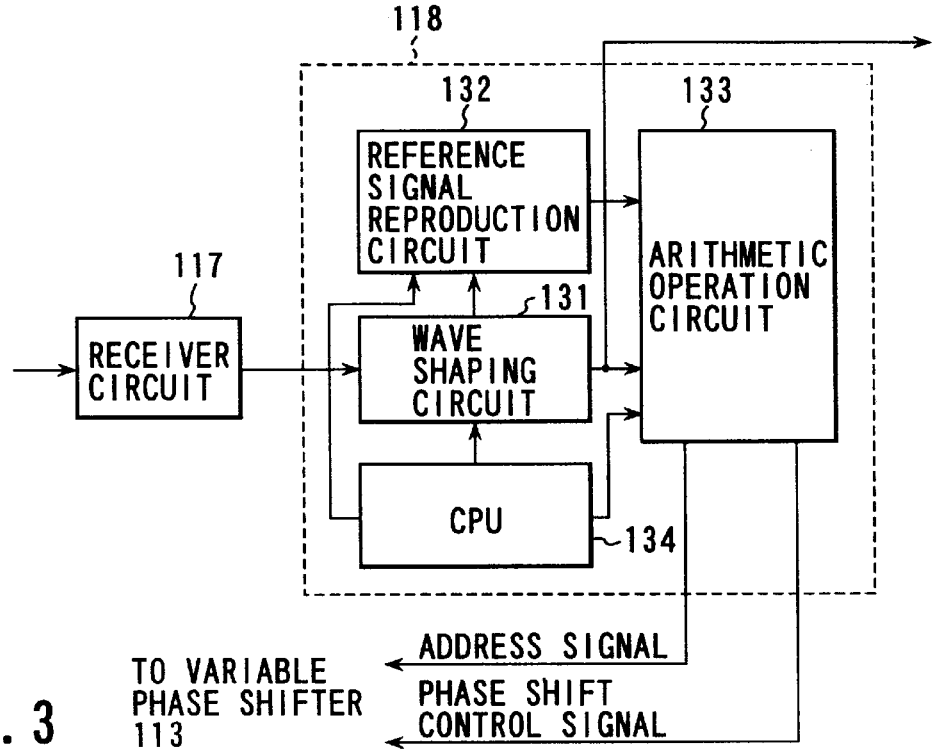
FIG. 3 is a circuit diagram showing the control circuit shown in FIG. 1.

The control circuit 118 is structured as shown in FIG. 3. That is, decoding and removable of the preamble of the demodulated and detected signal supplied from the receiver circuit 117 are performed by the wave shaping circuit 131 if necessary. Thus, a received signal is generated. The generated received signal is transmitted to a next circuit, such as a detector circuit. Moreover, the received signal is supplied to an arithmetic operation circuit 133 to calculate a phase shift in the variable phase shifter circuit 113. A portion of the demodulated and detected signal for generating a reference signal is supplied to a reference signal reproduction circuit 132 so that the reference signal is reproduced. The reference signal is supplied to the arithmetic operation circuit 133 to be compared with the received signal.

The arithmetic operation circuit 133 uses, for example, the LMS algorithm to calculate the phase shift. The wave shaping circuit 131, the reference signal reproduction circuit 132 and an arithmetic operation circuit 133 are controlled by a CPU 134.

The quadrature modulator 125 will furthermore be described with reference to FIG. 4. The quadrature modulator 125 comprises a quadrature local signal generator 141, two multipliers 142 and 143 and an adder 144. The quadrature modulator 125 multiplies the phase shift control signals of the channels I and Q and two quadrature local signals generated by the quadrature local signal generator 141. Then, the quadrature modulator 125 adds/subtracts outputs so as to output an intermediate-frequency local signal, the phase shift of which has been controlled in response to the phase shift control signals I and Q. The quadrature local signal generator 141 comprises a 90°-phase shifter and supplies the local signal to the multiplier 143 as it is. The quadrature local signal generator 141 supplies the local signal to the multiplier 142 through the 90°-phase shifter. In general, the phase $\phi$ is arctan (Q/I) as shown in FIG. 5 when the amplitude of the input signal to the channels I and Q of the quadrature modulator are I and Q, respectively. Therefore, when appropriate phase shift control signals to the channels I and Q of the quadrature modulator 125, the phase $\phi$ can be varied in a range from −180° to +180°. Thus, a 360°-phase shifter is realized.

Figure 6:
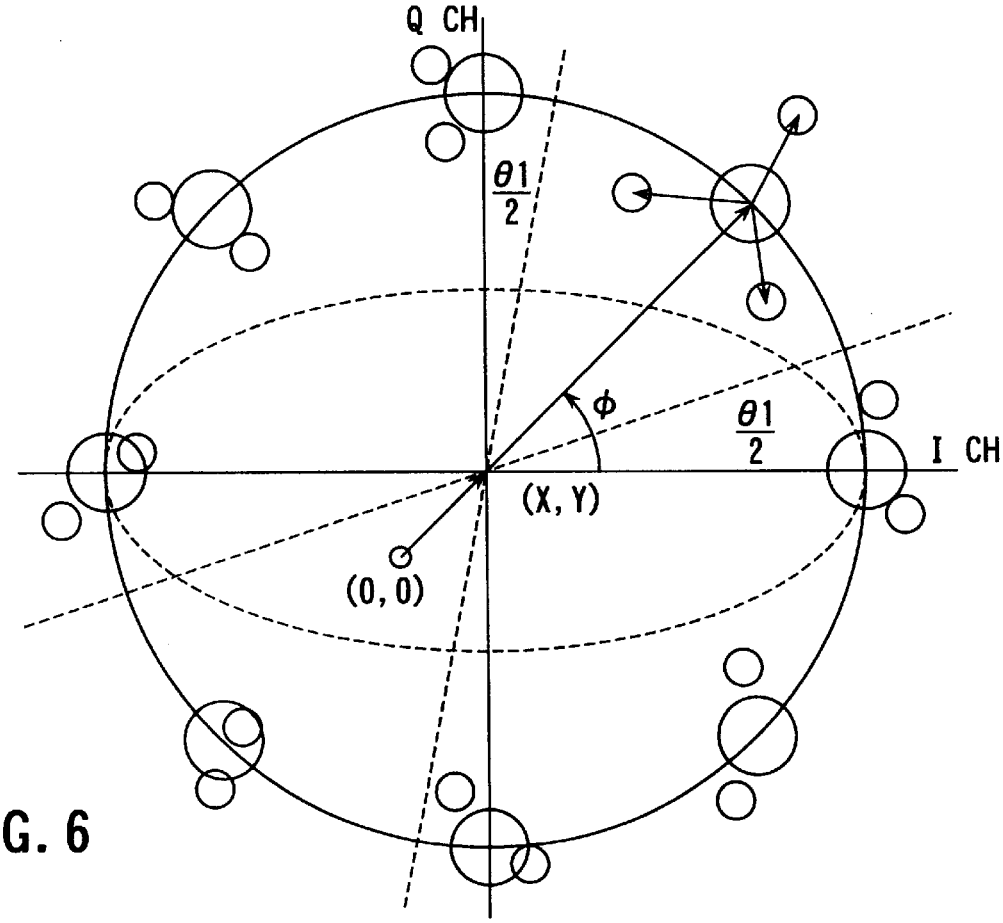
FIG. 6 is a diagram showing the operation which is performed by the quadrature modulator.

A specific example will now be described. When signal 1 is supplied as the phase shift control signal for each of the channels I and Q, the output from the quadrature modulator 125 is $\cos(\omega c\ t)+\sin(\omega c\ t)=\sin(\omega c\ t+\pi/4)$. The foregoing operation is shown in FIG. 6. FIG. 6 shows an example in which $\phi=\pi/4$.

The quadrature modulator uses two quadrature local signals to determine the accuracy of the phase of the output signal in accordance with the accuracy of the input signals to the channels I and Q. The phase shift control signals of the channels I and Q are generated by the accurate D/A converters 122 as shown in FIG. 2 so that an accurate phase shift is permitted.

The operation of the active array antenna system according to this embodiment will now be described.

When the operation is started, the arithmetic operation circuit 133 in the control circuit 118 generates an initial value of the phase shift which must be given to the variable phase shifter circuit 113. The initial values may simply have the same weight for all of the quadrature modulators 125 or the initial values may have weights with which the directional beam is directed to a predetermined instructed direction. The arithmetic operation circuit 133 outputs a phase shift control signal, which is an M-bit digital signal indicating the phase shift, and an address signal instructing a second frequency converter 110, to supply the foregoing signals to the demultiplexer 121 shown in FIG. 2.

The demultiplexer 121 sequentially outputs the M-bit phase shift control signal to each of the D/A converters 122 in response to the address signal. The D/A converters 122 convert the phase shift control signals into analog signals. If necessary, the spurious of the analog signal is removed by the low pass filter 124, and then the analog signal is supplied to either of the inputs I and Q of the quadrature modulator 125 as a control signal. Another input of the quadrature modulator 125 is supplied with the intermediate-frequency local signal output from the local signal generator 111 and divided by the divider 112. As a result, the quadrature modulator 125 outputs the intermediate-frequency local signal having a required phase shift. The intermediate-frequency local signal is supplied to an input of the second frequency converter 110 for receiving the local signal.

The relationship between the phase shift and the phase shift control signals $I_k$ and $Q_k$ (k is an integer from 1 to N and N is the number of the element antennas 101) when the quadrature modulators 125 which receives the intermediate-frequency local signal and the phase control signals is employed as a part of the variable phase shifter circuit 113 are shown in FIG. 5.

Note that the quadrature local signal generator 141 may comprise a frequency divider comprising a flip-flop or a CR-RC bridge in place of the 90° delay circuit to generate two quadrature local signals. The phase error is, in the foregoing case, 3° or smaller. By employing the foregoing technique, the 360°-phase shifter involving an error of about 3° can easily be realized by employing the quadrature modulator 125.

Figure 7:
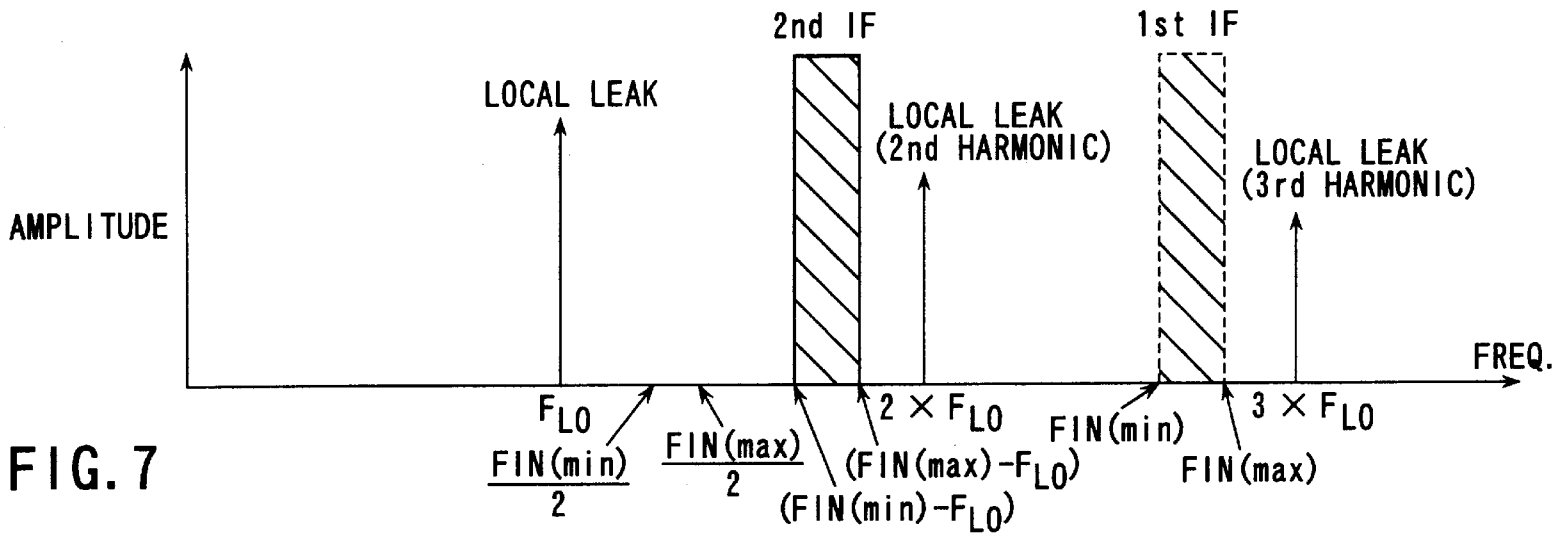
FIG. 7 is a graph showing the relationship between the intermediate frequency and the local frequency of the active array antenna system according to the first embodiment.
Figure 8:
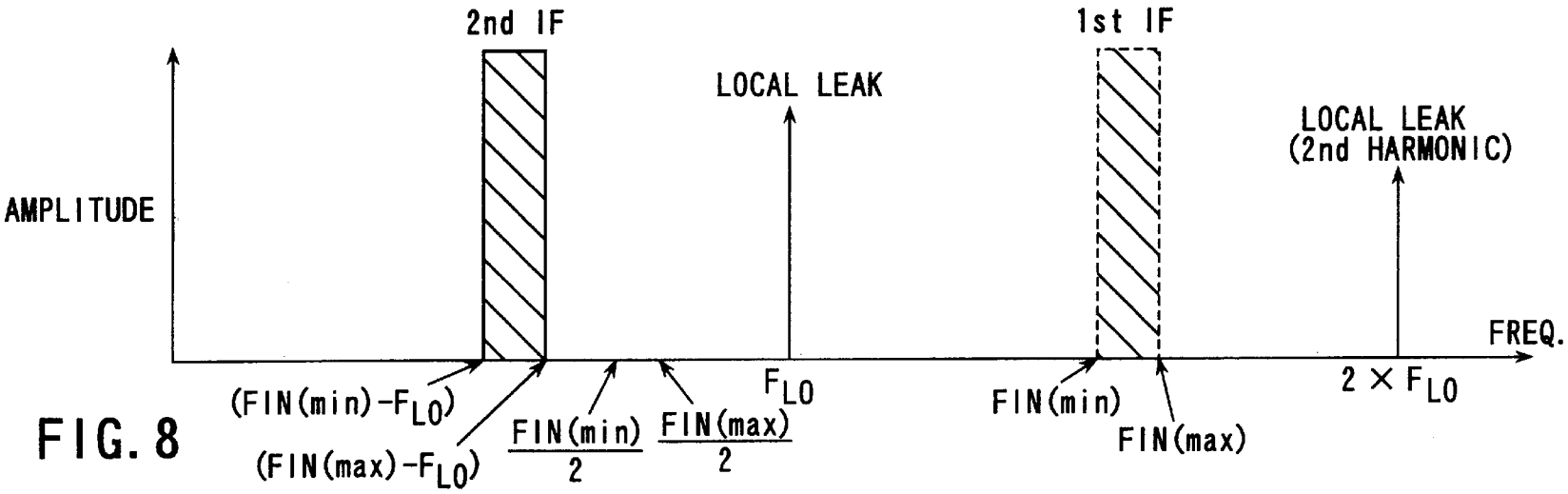
FIG. 8 is a graph showing the relationship between the intermediate frequency and the local frequency of a general wireless system.

In the foregoing description, the relationship between the input frequency (the second intermediate-frequency) to the second frequency converter 110 and the frequency of the intermediate-frequency local signal is not specified. It is preferable that the relationship is determined as follows. FIG. 7 shows the relationship among the frequencies of the signals. FIG. 8 shows the relationship of frequencies in a usual wireless unit.

This embodiment is characterized in that the frequency band $F_{in}$(min) to $F_{in}$(max) of the first intermediate-frequency signal, which is the input of the second frequency converter 110, and the frequency $F_{LO}$ of the frequency of the intermediate-frequency local signal satisfies $F_{LO}<F_{in}(\min)/2$ and $F_{LO}<F_{in}(\min)/(n+1)$ or $F_{LO}>F_{in}(\max)/(n+1)$ with regard to all integers n not smaller than two.

In general, when the intermediate frequency for a wireless unit is determined, the second intermediate-frequency is usually $F_{in}-F_{LO}$ when the first intermediate-frequency signal is expressed as $F_{in}$ and the local frequency is expressed as $F_{LO}$. Since the second frequency converter 110 has a great non-linear characteristic, the output of the second frequency converter 110 contains the frequency $F_{LO}$ of the intermediate-frequency local signal and its harmonic component. To easily remove the unnecessary components by the band pass filter 114, the frequency $F_{LO}$ of the intermediate-frequency local signal which is lowest among the unnecessary components is usually made to be higher than the second intermediate-frequency. That is, the relationship $F_{LO}>F_{in}(\max)/2$ is made to be satisfied, as shown in FIG. 7.

In general, a low-cost and accurate quadrature modulator has a relatively low operation frequency. When the width of the frequency band per frequency channel of the wireless communication system is large, the second intermediate-frequency $F_{in}-F_{LO}$ is made to be a relatively high frequency to minimize the specific frequency band. In this case, the structures of the filter and the like can be simplified. If no problem arises when the relationship $F_{LO}<F_{in}$ (min)/2 is satisfied to make the second intermediate-frequency to be a relatively high frequency, the active array antenna system according to the foregoing embodiment and satisfying the two conditions can easily be realized at a low cost.

Therefore, the frequency $F_{LO}$ of the intermediate-frequency local signal is determined to realize $F_{LO}\leqq F_{in}$ (min)/2. In the foregoing case, $F_{in}(\max)-F_{LO}\geqq F_{in}(\min)-F_{LO}>F_{LO}$. Thus, the frequency is converted by the second frequency converter 110. Then, the band pass filter 114 having the pass band which is the frequency band ($F_{in}$(min)−$F_{LO}$) to ($F_{in}$(max)−$F_{LO}$) of a required second intermediate-frequency is able to remove the frequency $F_{LO}$ of the intermediate-frequency local signal contained in the output of the second frequency converter 110.

Then, under the condition that $F_{LO}<F_{in}(min)/2$, the frequency $F_{LO}$ of the intermediate-frequency local signal is made such that $(F_{in}(min)-F_{LO})<(n\times F_{LO})<(F_{in}(max)-F_{LO})$ is not satisfied regarding to all integers n not smaller than two with respect to the input frequency band $F_{in}$(min) to $F_{in}$(max) of the second frequency converter 110, as shown in FIG. 7. Namely, the foregoing frequency is made such that $F_{LO}<F_{in}(min)/(n+1)$ or $F_{LO}>F_{in}(max)/(n+1)$ is satisfied regarding to all integers n not smaller than two. Thus, the band pass filter 114 having the pass band which is the frequency band ($F_{in}$(min)−$F_{LO}$) to ($F_{in}$(max)−$F_{LO}$) of a required second intermediate-frequency is able to remove the harmonic component of the frequency $F_{LO}$ of the intermediate-frequency local signal contained in the output of the second frequency converter 110. As a result, undesirable introduction of spurious into the received signal can be prevented. Thus, the active array antenna system according to the embodiment can be realized.

Since the foregoing setting of the frequency is employed, a quadrature modulator which is a low-cost and accurate quadrature modulator which can be operated at a relatively low frequency can be employed as the quadrature modulator 125. The quadrature modulator 125 is disposed in the variable phase shifter circuit 113 which shifts the phase of the intermediate-frequency local signal having a relatively low frequency. Therefore, an effect can be obtained in that an accurate active array antenna system can easily be realized.

Then, the effects of the active array antenna system according to this embodiment having the above-mentioned structure will now be described.

(1) In general, the intermediate frequency can be made to be lower than the frequency of the carrier wave. Therefore, the variable phase shifter circuit 113 for the intermediate-frequency local signal can be realized at low cost and accurately. The realized cost and accuracy are those as compared with the variable phase shifter circuit for the carrier-wave frequency local signal for use in the conventional active array antenna system. Therefore, the accurate active array antenna system can easily be realized.

(2) The local signal generator 105 for generating a local signal having a variable frequency is provided for the first frequency converter 104 which converts the frequency of the carrier wave to the first intermediate frequency. Therefore, if switching among a plurality of frequency channels must be performed in the frequency band of the communication system, the first intermediate frequency which is supplied to the next second frequency converter 110 can be fixed.

Therefore, also the frequency of the local signal can be fixed which must be supplied to the input of the second frequency converter 110 for receiving the first intermediate frequency signal. Therefore, the necessity for the conventional phase shifter circuit for the carrier-wave frequency local signal for use in the conventional active array antenna system can be eliminated. The eliminated necessity for the variable phase shifter circuit 113 is a necessity of widening the frequency range for the input local signals. As a result, the fractional bandwidth for the operation frequency for the local signal can significantly be narrowed. As a result, cost reduction is permitted. Thus, the cost of the active array antenna system can furthermore be reduced.

(3) In this embodiment, the quadrature modulator 125 is provided for the variable phase shifter circuit 113. Therefore, the phase of the carrier-wave frequency local signal can continuously be varied for a full range of 360° in response to the phase shift control signal. Moreover, the advantages can be obtained in that the phase shift can easily be controlled and the accuracy of the carrier-wave frequency can be improved. Therefore, the accuracy of the active array antenna system can advantageously be improved.

(4) It might be considered to employ an application of the active array antenna system wherein the beam is varied during communication. The foregoing application can conveniently be realized by causing the D/A converters 122 to generate the phase shift control signal for the channels I and Q, as shown in FIG. 2. The reason for this lies in that the phase shift control signal for the channels I and Q can be varied in response to the digital signal supplied to the D/A converters 122. As a result, an antenna beam can arbitrarily be varied during communication. In the foregoing case, the phase shift control signals for the channels I and Q can be varied. Therefore, the phase shift control signal contains a low frequency component.

(5) As known, the output of the D/A converters 122 encounters generation of aliasing distortion in the frequencies which is integer multiples of the operation clock frequency ($f_{ck}$) not smaller than 2. Therefore, the aliasing distortion of signals except for required signals must be removed. If the aliasing distortion exists in the output of the D/A converter 122, the frequency is undesirably converted by the quadrature modulator 125. As a result, spurious is undesirably generated.

Figure 4:
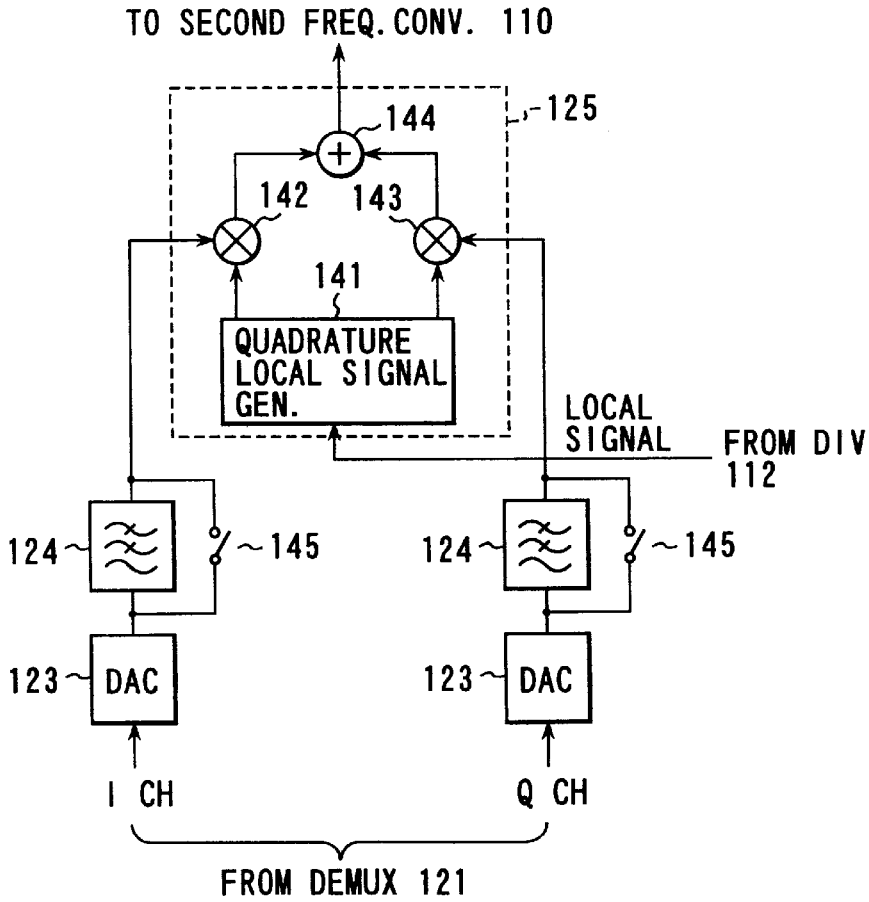
FIG. 4 is a circuit diagram of a quadrature modulator for use in the variable phase shifter circuit shown in FIG. 2.
Figure 5:
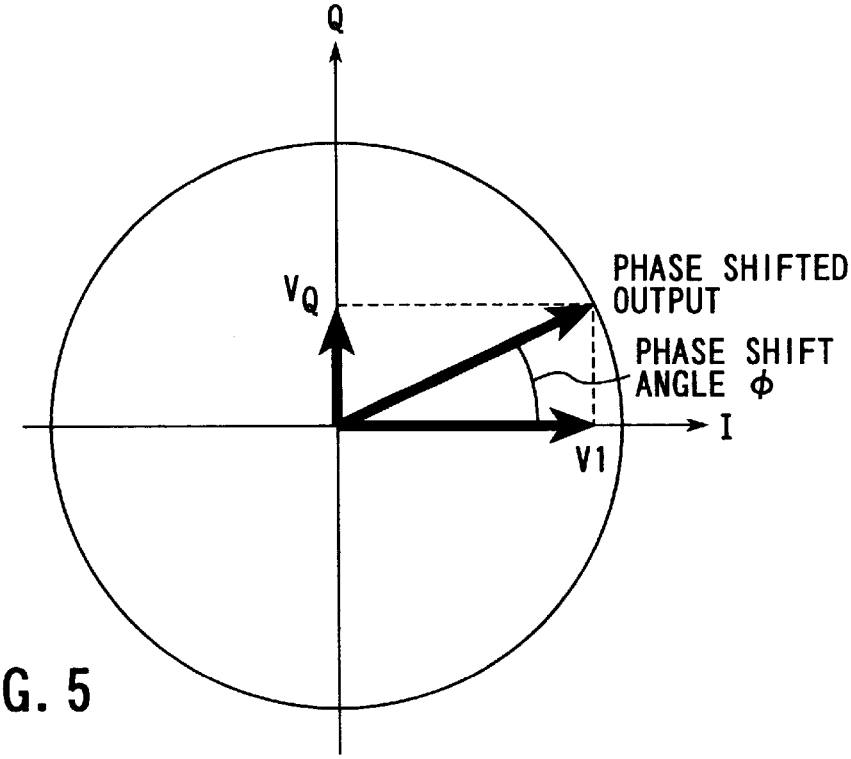
FIG. 5 is a diagram showing the principle of the operation of the quadrature modulator.
Figure 9:
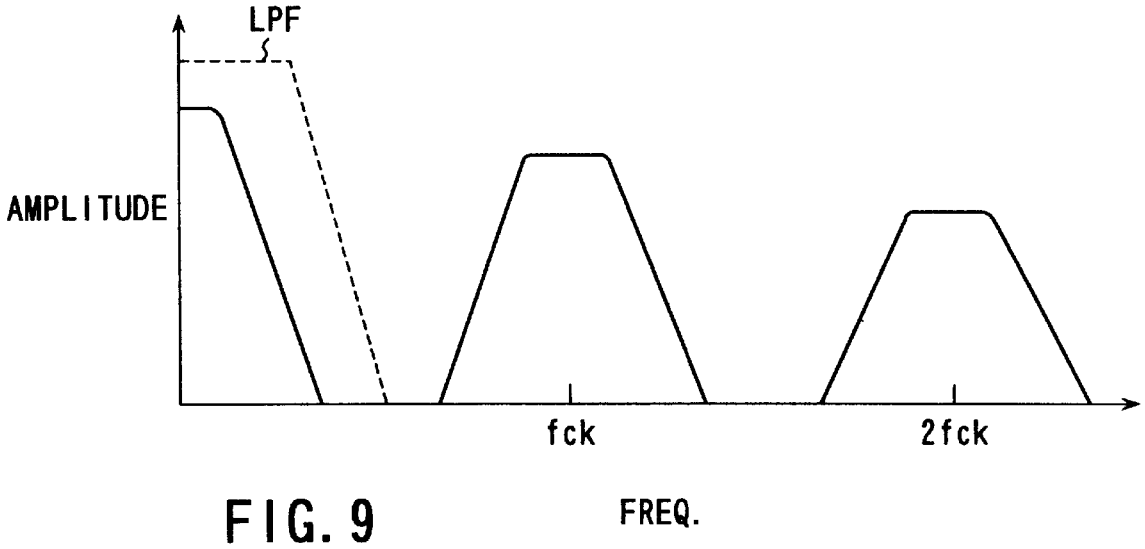
FIG. 9 is a graph showing an aliasing distortion of a D/A converter of the variable phase shifter circuit shown in FIG. 2 and the characteristic of a low-pass filter for removing the aliasing distortion.

In this embodiment, as shown in FIGS. 2 and 4, the low pass filters 124 having a sufficient attenuation characteristic set at the frequency $f_{ck}/2$ which is half the operation clock frequency $f_{ck}$ is disposed between the D/A converters 122 and the quadrature modulators 125. Therefore, the aliasing distortion can be removed. FIG. 9 shows the relationship between aliasing distortion (solid lines) generated in the D/A converters 122 and the frequency characteristic (a broken line) of the low pass filters 124 for removing the aliasing distortion.

(6) The low pass filters 124 is able to effectively remove the aliasing distortion generated in the D/A converters 122. Moreover, the low pass filters 124 is able to effectively remove spurious generated during transmission when the active array antenna system according to the present invention is applied to a TDMA (time division multiple connection) system.

Figure 10:
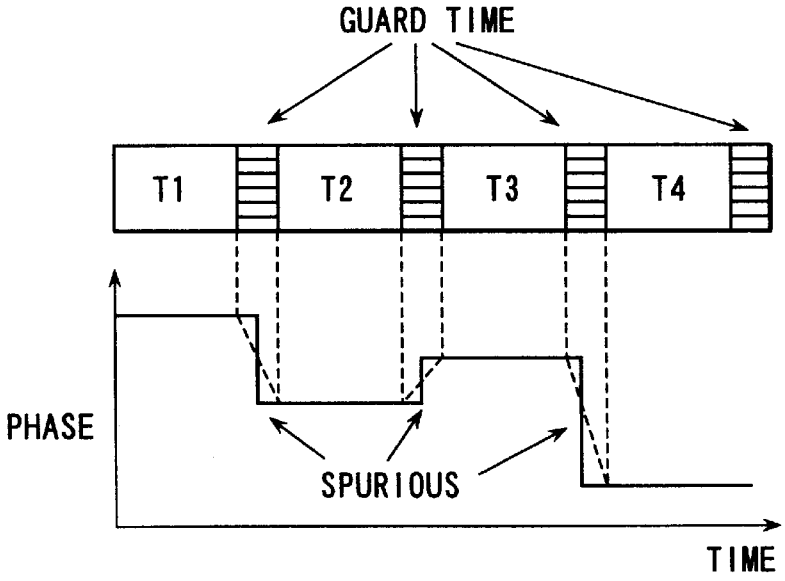
FIG. 10 is a graph showing phase shift between time slots when the active array antenna system according to the first embodiment is employed in a TDMA system.

That is, as shown in FIG. 10, the TDMA system uses time division time-slots T1, T2, . . . , to perform transmission. The phase of the local signal must be varied in each guard time region between time-slots. If the phase of the local signal is rapidly changed as indicated with the solid line shown in FIG. 10, spurious is generated during the transmission. Thus, the environment for the electric waves deteriorates.

If the low pass filter 124 is disposed between the D/A converter 122 and the quadrature modulator 125 as is employed in this embodiment, the time constant of the low pass filter 124 causes the phase of the local signal to gradually be changed as indicated with broken lines shown in FIG. 10. That is, rapid phase change can be prevented. As a result, generation of spurious during transmission can satisfactorily be prevented. FIG. 4 shows a switch 145 connected between the input and output of the low pass filter 124. The switch 145 short-cuts a region between the input and the output of the low pass filter 124 when the spurious does not arise a problem because of the specification of the employed wireless system.

(7) The variable phase shifter circuit 113 according to this embodiment comprises a plurality of phase shift control paths which corresponds to the element antennas 101 and each of which is composed of the D/A converter 122, the low pass filter 124 and the quadrature modulator 125, as shown in FIG. 2. To accurately manufacture the active array antenna system and to facilitate the adjustment operation, it is preferable that the plural phase shift control paths have the same characteristics. To make the characteristics to be the same, it is preferable that the paths have the same circuit structures. In particular, the D/A converters 122, which are main factors for determining the accuracy, must have the accurately same characteristics.

According to this embodiment, the reference voltage (for use to make a comparison with the output voltage from a local A/D converter disposed in the D/A converter 122) for use in each D/A converter 122 is supplied from the common reference voltage generator 123, as shown in FIG. 2. Thus, dispersion of the characteristics except for the dispersion of each D/A converter 122 can satisfactorily be prevented. As a result, the foregoing requirement can be met.

A variety of modifications of this embodiment is permitted. This embodiment comprises the variable phase shifter circuit 113 for varying, for each of the radio frequency circuits corresponding to the element antennas 101, the phase of the intermediate-frequency local signal which is supplied to the second frequency converter 110. The variable phase shifter circuit 113 is constituted by the quadrature modulator 125 having the input for receiving the intermediate-frequency local signal and the phase shift control signals. The quadrature modulator 125 or a portion including the quadrature modulator 125 and the local signal generator 111 and the local signal divider 112 may be replaced with a direct digital synthesizer which is capable of controlling the phase or a portion of the direct digital synthesizer.

If the output level of the second frequency converter 110 is varied depending on the level of the intermediate-frequency local signal, the foregoing characteristic is used as follows: a function for controlling the output level of the variable phase shifter circuit 113 is added to the control circuit 118. Thus, the directional pattern can be formed which has null formed in a direction wherein a jamming electric wave is transmitted. Thus, the function of the active array antenna system can be improved. To control the output level of the variable phase shifter circuit 113, a variable gain amplifier may be provided between the quadrature modulator 125 and the second frequency converter 110. Thus, the gain of the variable gain amplifier is controlled by the control circuit 118.

Although the intermediate-frequency local signal generator 111 may simply comprise an oscillator, employment of a synthesizer capable of varying the output frequency enables the frequency of the intermediate-frequency local signal which must be supplied to the second frequency converter 110 to be varied.

When the carrier-wave frequency local signal generator 105 for converting the frequency of the carrier wave to the first intermediate-frequency signal comprises a synthesizer, reduction in the intervals among the variable frequencies of the system deteriorates the signal characteristics including SNR and CNR. To prevent this, the intervals among the variable frequencies of the synthesizer which is used as the carrier-wave frequency local signal generator 105 is relatively widened. As an alternative to this, a structure may be employed wherein the output frequency is fixed and the overall frequency band of the employed wireless system or a portion of the same is supplied to the first frequency converter 104 or the following band pass filter 107 and ensuing portions. Moreover, the actual selection of a channel is performed by varying the frequency of the intermediate-frequency local signal which is supplied to the second frequency converter 110.

If the beam width of the active array antenna system can be narrowed and a possibility that another wireless unit (which may be the active array antenna system or another antenna system) causes interference to occur is low, it is preferable that the structure according to this embodiment may be employed. In the foregoing case, the cost of the synthesizer serving as the local signal generator 105 can be reduced. Therefore, an effect can be obtained in that the overall cost of the active array antenna system can be reduced.

In this embodiment, the variable phase shifter circuit 113 is provided for, for each radio frequency circuit connected to the element antenna 101, varying the phase of the intermediate-frequency local signal which is supplied to the second frequency converter 110. A variable phase shifter for a carrier-wave frequency local signal may be provided which varies the phase of the carrier-wave frequency local signal which is supplied to the frequency converter. The frequency converter is a converter for converting the frequency between the frequency of the carrier wave and the first intermediate-frequency signal.

In the foregoing case, as shown in FIG. 2, the variable phase shifter for the carrier-wave frequency local signal comprises a quadrature converter having inputs for receiving the carrier-wave frequency local signal and the phase shift control signal. Thus, an effect can be obtained similarly to the structure shown in FIG. 2 wherein the variable phase shifter circuit 113 for the intermediate-frequency local signal comprises the quadrature modulator.

If the output level of the second frequency converter 110 is varied depending on the level of the input intermediate-frequency local signal, the foregoing characteristic is used as follows: a function for controlling the output level of the variable phase shifter circuit 113 is added to the control circuit 118. Thus, the directional pattern can be formed which has null formed in a direction wherein a jamming electric wave is transmitted. Thus, the function of the active array antenna system can be improved. To control the output level of the variable phase shifter circuit 113, a variable gain amplifier may be provided between the variable phase shifter circuit 113 and the second frequency converter 110. Thus, the gain of the variable gain amplifier is controlled by the control circuit 118.

Other embodiments of the active array antenna system according to the present invention will be described. The same portions as those of the first embodiment will be indicated in the same reference numerals and their detailed description will be omitted.

Second Embodiment

Figure 11:
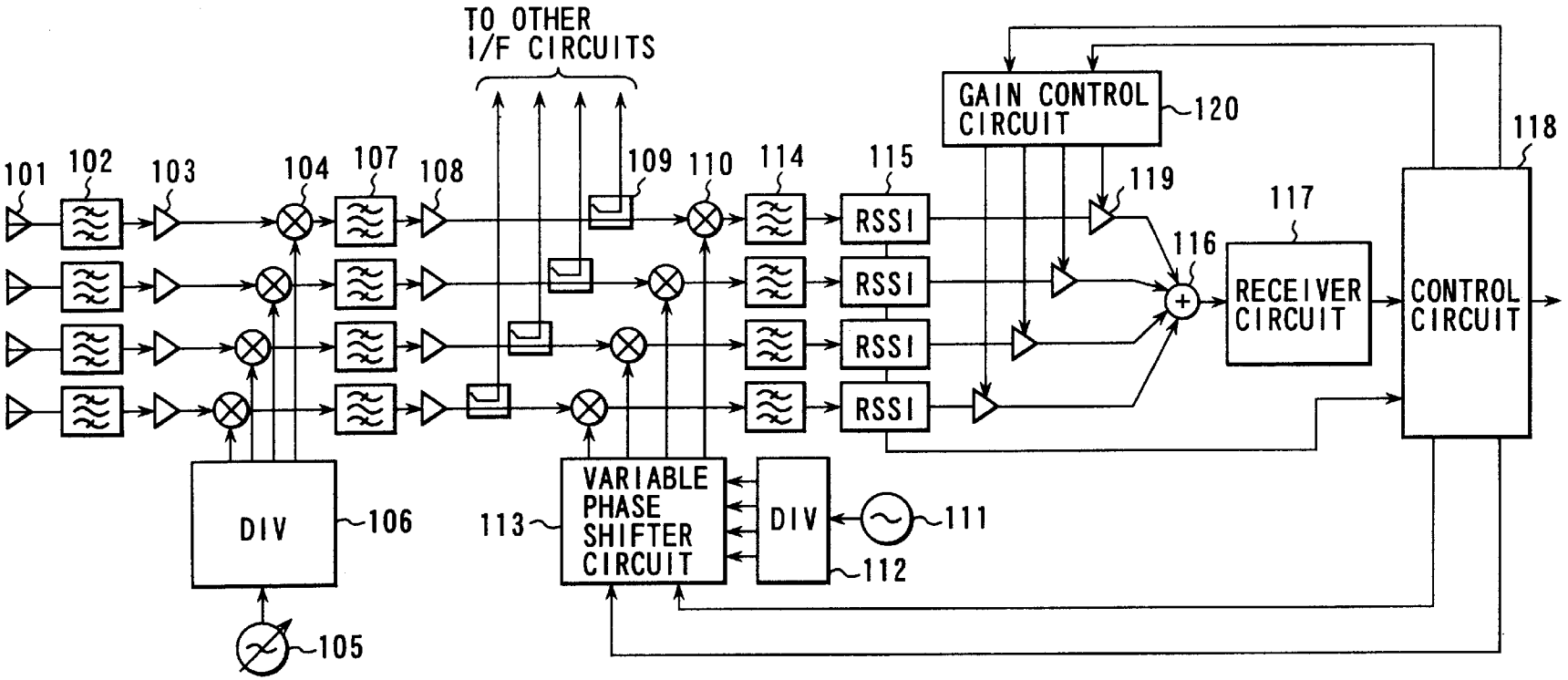
FIG. 11 is a block diagram showing the schematic structure of the active array antenna system of a second embodiment according to the present invention.

FIG. 11 shows a second embodiment of the active array antenna system according to the present invention. This embodiment is different from the first embodiment shown in FIG. 1 in that a variable gain amplifier 119 serving as a gain varying circuit for varying the gain of the signal for each radio frequency circuit connected to each element antenna 101 is added to the active array antenna system according to the first embodiment.

As compared with the first embodiment wherein only the phase of the signal is controlled for each element antenna 101, this embodiment wherein also the amplitude of the signal can be controlled is able to variously control the directional pattern of the active array antenna system. Therefore, the performance including suppression of an interference wave can be improved. That is, control of as well as the gain enables null to be imparted to the directional pattern.

The gain of the variable gain amplifier 119 is controlled by the gain control circuit 120 in response to a gain control signal supplied from the control circuit 118. In this embodiment, the arithmetic operation circuit 133 in the control circuit 118 shown in FIG. 3 calculates an amplitude weight by using the LMS algorithm in addition to the phase shift. To supply the amplitude weight to the variable phase shifter circuit 113 and the gain control circuit 120, a phase shift control signal and a gain control signal in the form of digital signals are output.

Figure 12:
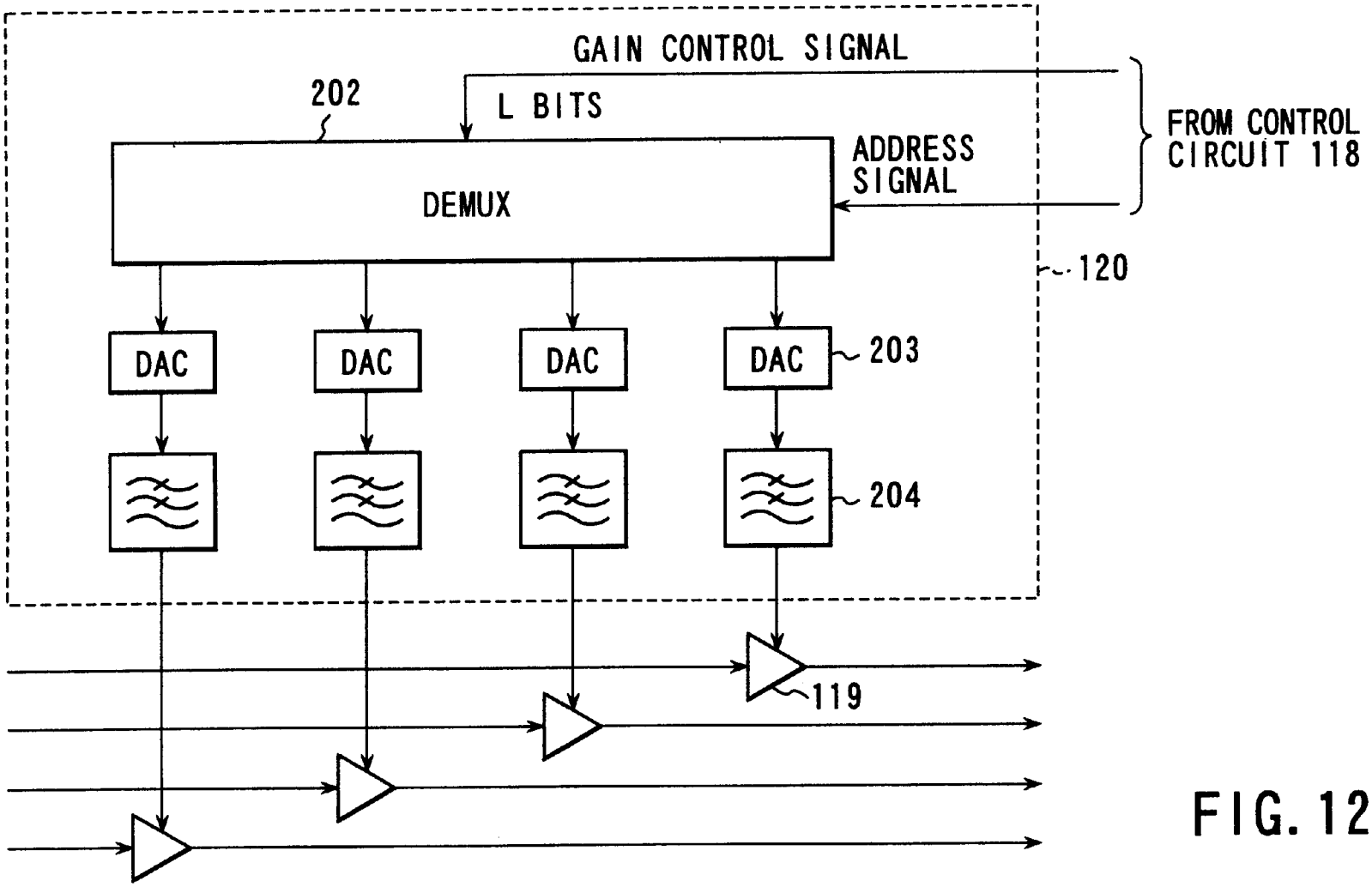
FIG. 12 is a block diagram showing the structure of a gain control circuit according to the second embodiment.

FIG. 12 shows a schematic example of the gain control circuit 120 which comprises a demultiplexer 202, D/A converters 203 and low-pass filters 204. The demultiplexer 202, from the control circuit 118, receives an L-bit digital signal (the gain control signal) and an address signal for specifying the variable gain amplifier 119, the gain of which must be controlled. In accordance with the address signal, the demultiplexer 202 sequentially outputs the gain control signal to each D/A converter 203. The D/A converter 203 converts the gain control signal into an analog signal. If necessary, spurious is removed by the low-pass filter 204 because of the reason described in the first embodiment. Then, the gain control signal is, as a control voltage, supplied to the variable gain amplifier 119. As a result, the second intermediate-frequency signal extracted through the RSSI circuit 115 is amplified with a required gain in the variable gain amplifier 119 so that the amplitude weight is imparted.

In general, the wireless unit has a reception portion provided with AGC (automatic gain control) for adjusting the input level to the detector having a limited dynamic range. Therefore, it might be considered feasible to employ the AGC circuit for the same purpose for the variable gain amplifier 119 according to this embodiment so that both of control of the amplitude weight and the gain control for the AGC are performed. In the foregoing case, the amount of the gain control performed by the AGC circuit and arranged to be imparted to all of the variable gain amplifiers 119 and the amount of gain control corresponding to the amplitude weight which is supplied from each element antenna 101 to the signal are added to each other so that a gain control signal is formed. The gain control signal is supplied from the control circuit 118 to the gain control circuit 120.

As a result, the variable gain amplifier 119 for imparting the amplitude weight and the variable gain amplifier for the AGC can be unified. Thus, an effect can be obtained in that the controllability of the directional pattern of the active array antenna system can be improved without enlargement of the size of the circuit.

Third Embodiment

Figure 13:
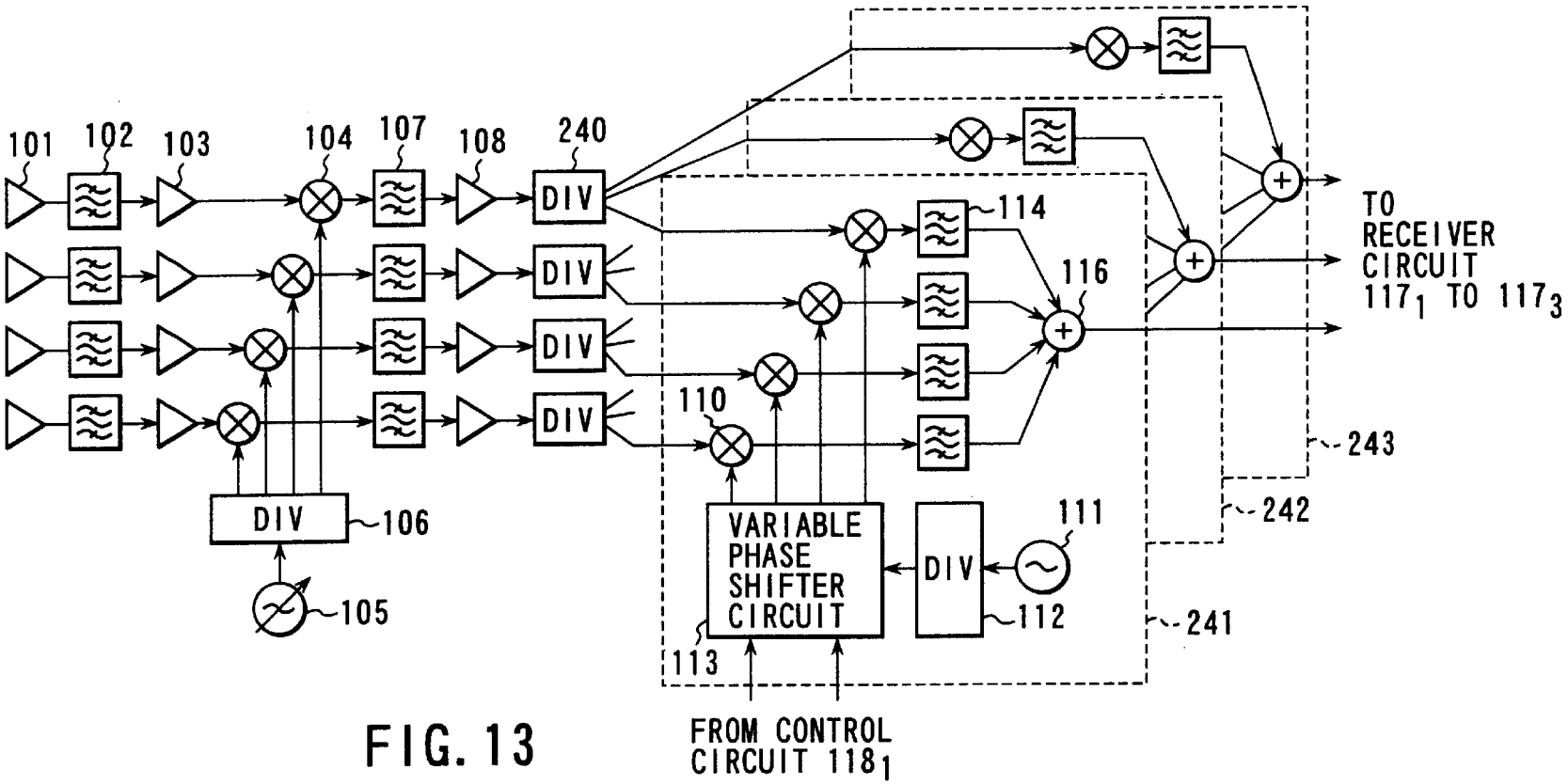
FIG. 13 is a block diagram showing the active array antenna system of a third embodiment according to the present invention.

FIG. 13 shows the structure of an essential portion of a third embodiment of the active array antenna system according to the present invention.

Similarly to the first embodiment, a noise component deviated from the frequency band of the RF signal supplied from each element antenna 101 is removed by the RF filter 102. Then, the RF signal is amplified by the low-noise amplifier 103. Then, the first frequency converter 104 converts the frequency from the carrier-wave frequency to the first intermediate-frequency by using the carrier-wave frequency local signal supplied from the local signal generator 105 through the divider 106. Then, the band pass filter 107 removes a noise component deviated from a required channel. Then, the amplifier 108 amplifies only the first intermediate-frequency signal.

The first intermediate-frequency signal supplied from the amplifier 108 is divided into three signals by an intermediate-frequency-signal divider 240 so as to be supplied to beam forming circuits 241, 242 and 243. The beam forming circuits 241, 242 and 243 have the same structures each of which comprises the second frequency converter 110, the intermediate-frequency local signal generator 111, the local signal divider 112, the variable phase shifter circuit 113, the band pass filter 114 and the adder 116. Output signals from the beam forming circuits 241, 242 and 243 are supplied to reception circuits $\mathbf{117}_1$ to $\mathbf{117}_3$ (circuits similar to the receiver circuit 117 according to the first embodiment) (not shown).

The variable phase shifter circuit 113 in each of the beam forming circuits 241, 242 and 243 is individually controlled in accordance with a phase shift control signal supplied from each of control circuits $\mathbf{118}_1$ to $\mathbf{118}_3$ (not shown) (circuits similar to the control circuit 118 according to the first embodiment) connected to the reception circuits $\mathbf{117}_1$ to $\mathbf{117}_3$. Therefore, reception directional beams controlled individually can be formed. That is, signals received with the corresponding reception directional beams can be obtained from the reception circuits connected to the beam forming circuits 241, 242 and 243.

According to this embodiment, effects similar to those obtainable from the first embodiment can be obtained. Moreover, the following effects can be obtained.

(1) Since the plural beam forming circuits 241, 242 and 243 are provided, plural reception directional beams can independently be controlled. Therefore, simultaneous communication with a plurality of users can be performed. When the active array antenna system is applied as a mobile communication station, an advantage can be realized.

(2) The reception directional beams formed by the beam forming circuits 241, 242 and 243 can be operated at the same frequency. Thus, the direction or the shape of each of the beams can be controlled to prevent interference of the beams. Therefore, the same frequency can be reused by the number of the beams. Therefore, a significant effect can be obtained to effectively use the resource of the frequencies. As a result, the capacity of a station of a mobile communication can be enlarged. Thus, the cost can be reduced if the same performance is required. As a result, a significant utility value can be realized.

(3) When the beam forming circuits 241, 242 and 243 are formed into IC structures, the size and weight of each circuit can be reduced. Therefore, a convenient system can be realized.

This embodiment may variously be modified as follows. The beam forming circuits 241, 242 and 243 control the phase shifts of the intermediate-frequency local signals. For example, a structure similar to the second embodiment shown in FIG. 11 may be employed. The structure is formed such that the variable gain amplifier 119 and the gain control circuit 120 for controlling the amplitude weight and gain for the AGC are provided for each of the beam forming circuits 241, 242 and 243.

As an alternative to the intermediate-frequency-signal divider 240, a filter may be employed. When the filter is employed, the beam forming circuits 241, 242 and 243 can be operated at different frequencies. Moreover, an insertion loss occurring during operation of the divider can be reduced. As a result, the specification of the variable gain amplifier 119 can be moderated. The gain can be reduced and, therefore, the cost can be reduced.

The intermediate-frequency-signal divider 240 is not necessarily perform equal division. For example, the input level of the beam forming circuit which processes a signal among the received RF signal from a plurality of users which has a relatively high level is lowered. Moreover, the input level of the beam forming circuit for processing a signal having a relatively low level is relatively raised. Thus, the overall capacity can be improved.

Fourth Embodiment

Figure 14:
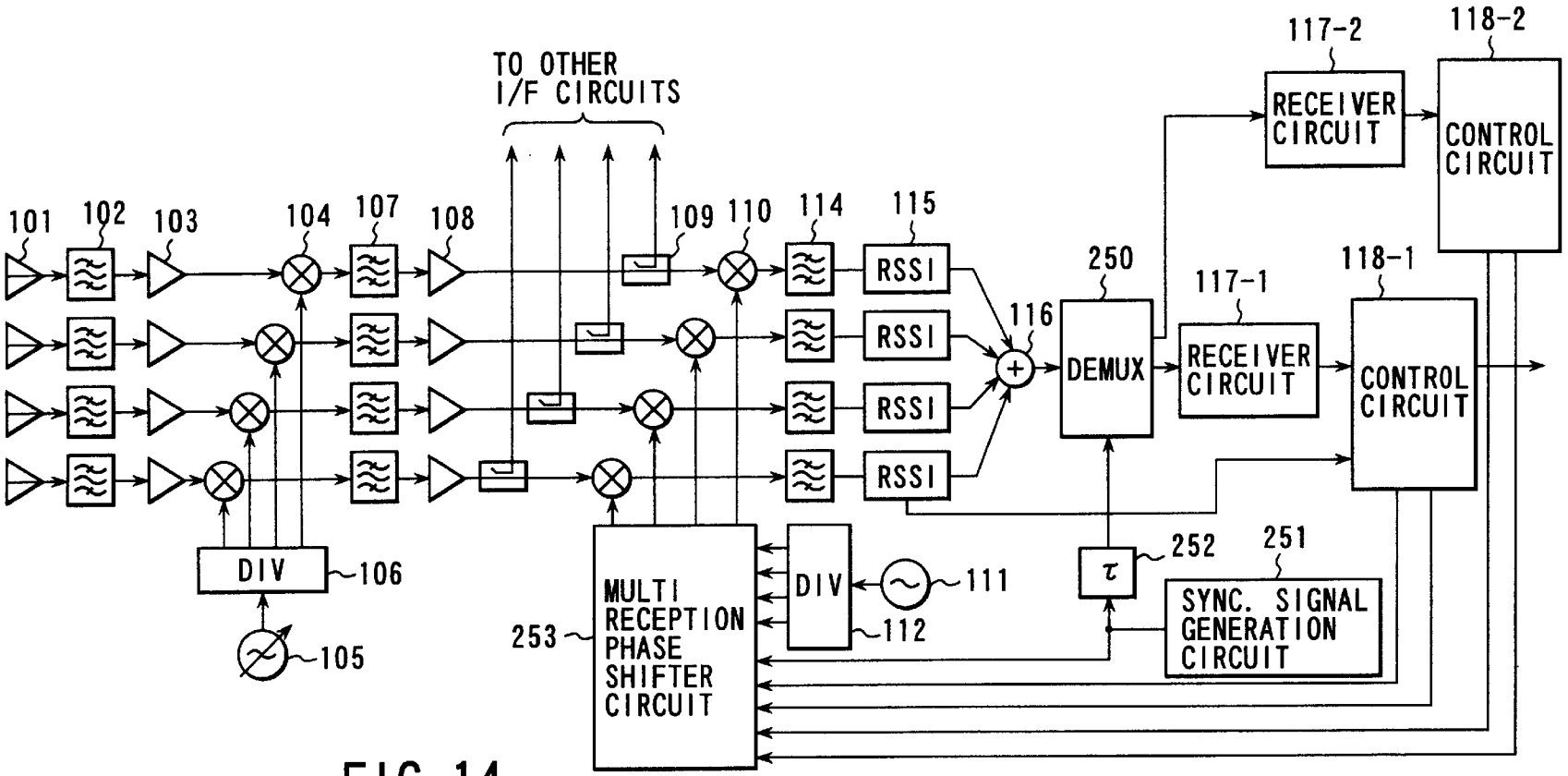
FIG. 14 is a block diagram showing the active array antenna system of a fourth embodiment according to the present invention.

FIG. 14 shows the structure of a fourth embodiment of the active array antenna system according to the present invention. This embodiment is structured to be capable of receiving RF signals from a plurality of wireless units disposed in different directions. The structure is constituted by adding, to the active array antenna system according to the first embodiment shown in FIG. 1, a demultiplexer 250 for dividing a second intermediate-frequency signal output from the adder 116 into a plurality of sections, for example, two. Moreover, a synchronizing signal generation circuit 251 and a delay circuit 252 are added. In addition, the variable phase shifter circuit for shifting the phase of the intermediate-frequency local signal is formed by a multi-reception phase shifter circuit 253.

The synchronizing signal generation circuit 251 is a circuit having a period shorter than the inverse of the transmission baud rate of a received RF signal. The synchronizing signal generation circuit 251 generates a synchronization signal which varies at time intervals shorter than time obtained by multiplying the inverse of the number of the received RF signal and the inverse of the transmission baud rate. The synchronization signal is, as a timing signal, supplied to the demultiplexer 250 through the delay circuit 252. Also the synchronization signal is supplied to the multi-reception phase shifter circuit 253, The delay circuit 252 will be described later.

The second intermediate-frequency signal divided by the demultiplexer 250 into two sections at the timing of the synchronization signal delayed by a predetermined time by the delay circuit 252 is supplied to reception circuits 117-1 and 117-2. Received signals from the reception circuits 117-1 and 117-2 are supplied to control circuits 118-1 and 118-2, respectively. The multi-reception phase shifter circuit 253 generates an intermediate-frequency local signal which varies the synchronization signal supplied from the synchronizing signal generation circuit 251.

Figure 15:
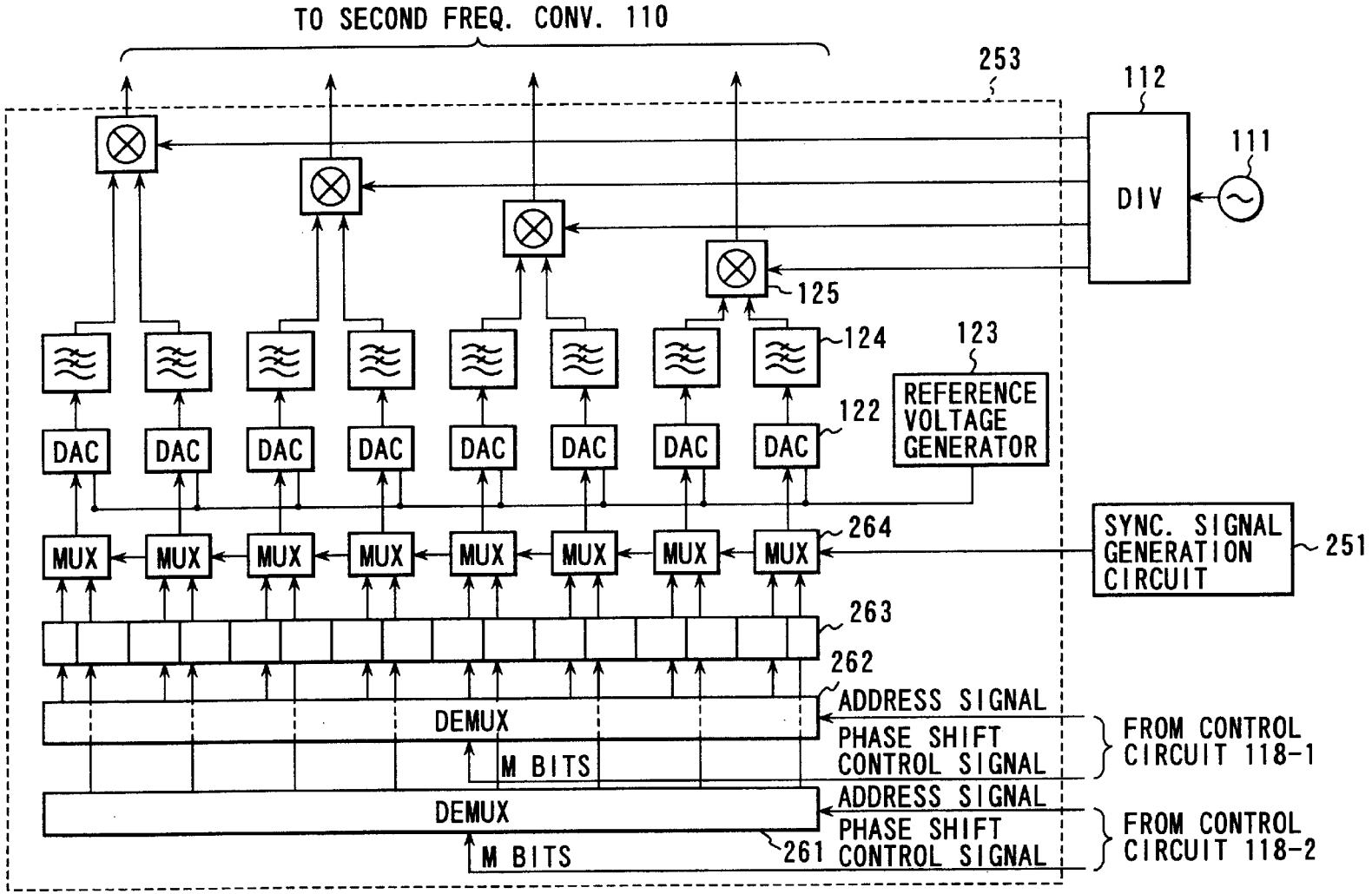
FIG. 15 is a block diagram showing the structure of a multi-reception phase shifter circuit according to the fourth embodiment.

FIG. 15 shows the structure of the multi-reception phase shifter circuit 253. The D/A converters 122, the reference voltage generator 123, the low pass filters 124 and the quadrature modulators 125 are similar to those shown in FIG. 2 which shows the structure of the variable phase shifter circuit 113 shown in FIG. 1. The multi-reception phase shifter circuit 253 furthermore comprises a demultiplexer 261 which is supplied with an address signal and a phase shift control signal (M bits) from the control circuit 118-1; a demultiplexer 262 which is supplied with an address signal and a phase shift control signal (M bits) supplied from the control circuit 118-2; 2N (N=4 in this embodiment) registers 263; and a 2-input multiplexer 264. Note that the registers 263 may be omitted from the structure.

The multiplexer 264 is switched in response to the synchronization signal supplied from the synchronizing signal generation circuit 251 so as to select either of two inputs from the register 263 to output the selected input. Thus, the phase shift of the local signal output from the multi-reception phase shifter circuit 253 varies in synchronization with the synchronization signal. Delay time $\tau$ of the delay circuit 252 is the same as signal delay time from the output of the register 263 (the input of the multiplexer 264) of the multi-reception phase shifter circuit 253 to the input to the demultiplexer 250 (through the second frequency converter 110 and the adder 116).

As a result of the above-mentioned structure wherein a small number of elements are added to the active array antenna system according to the first embodiment, RF signals transmitted from a plurality of wireless units existing in different directions can be received.

The operation of a structure will now be described which is performed when this embodiment is applied to a wireless communication system which employs a spectrum diffusion method.

Figure 16:
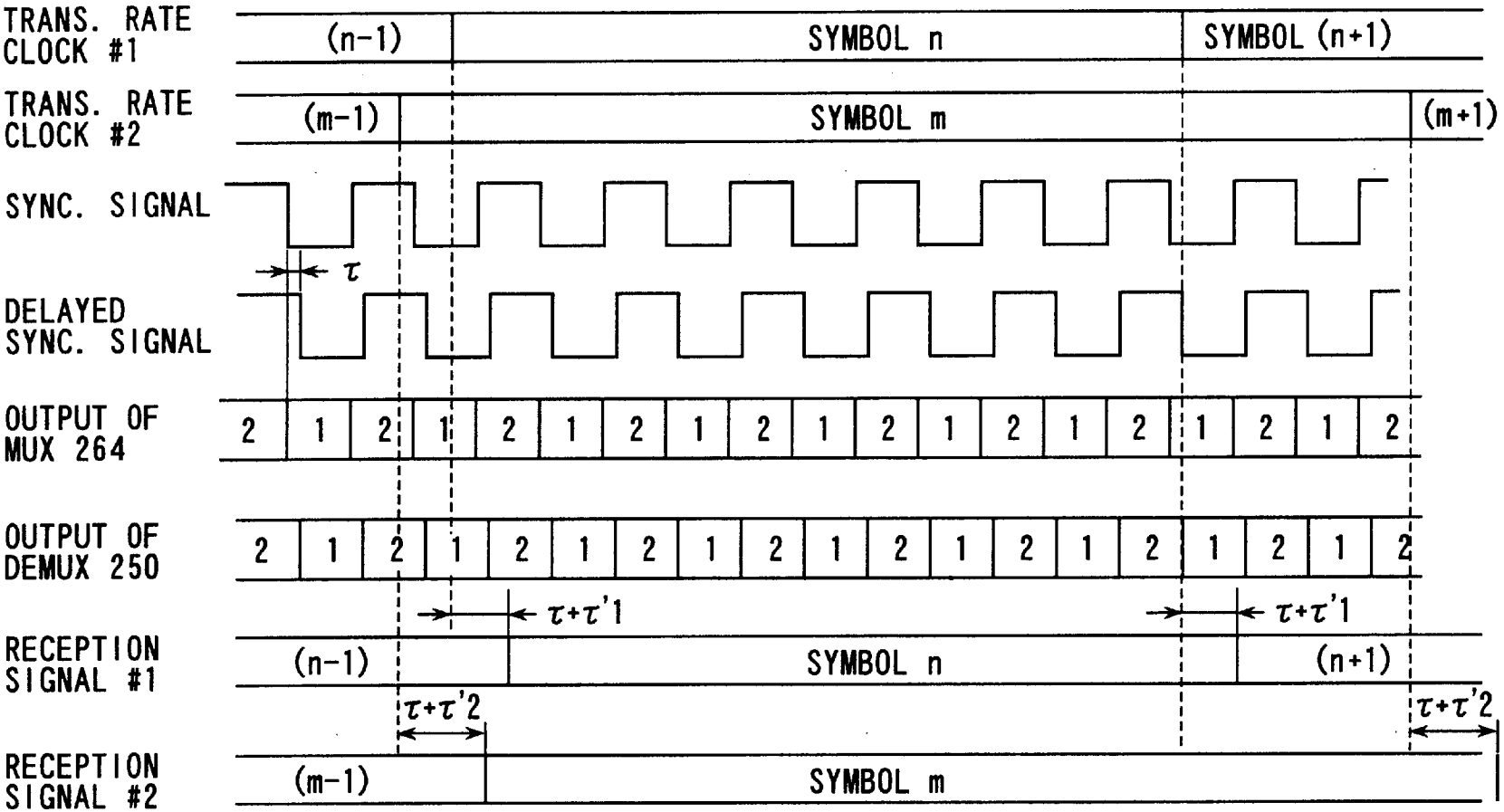
FIG. 16 is a timing chart showing the operation which is performed when the active array antenna system according to the fourth embodiment is applied to a wireless communication system which employs a spectrum diffusion method.

FIG. 16 is a timing chart showing the operation. FIG. 16 shows transmission rate clocks #1 and #2 of signals transmitted from wireless units #1 and #2 existing in different directions; a synchronization signal generated by the synchronizing signal generation circuit 251; a signal formed by delaying the synchronization signal by $\tau$ by the delay circuit 252; an output from the multiplexer 264 (the input of the D/A converters 122); an output from the demultiplexer 250 (inputs of reception circuits 17-1 and 17-2) and received signals #1 and #2 supplied from the reception circuits 117-1 and 117-2 corresponding to the signals transmitted from the wireless units #1 and #2 subjected to signal detection. Note that numerals "1" and "2" added to the outputs from the multiplexer 264 and the demultiplexer 250 indicate the correspondence to the signals transmitted from the wireless unit #1 or the wireless unit #2.

The active array antenna system according to this embodiment is able to receive a plurality of RF signals transmitted from a plurality of the wireless units (the wireless units #1 and #2) existing in different directions with transmission rate clocks #1 and #2.

The synchronization signal generated by the synchronizing signal generation circuit 251 is delayed by the delay circuit 252 from the output of the synchronizing signal generator 251 by signal delay time $\tau$ which takes in a region from the input of the multiplexer 264 to the input of the demultiplexer 250.

In accordance with the output from the synchronizing signal generation circuit 251, the input of the multiplexer 264 is switched. On the other hand, the output of the demultiplexer 250 is switched in accordance with the output from the delay circuit 252. As a result, the second intermediate-frequency signal obtained with the phase shift set by the control 118-1 is supplied to the receiver circuit 117-1. The second intermediate-frequency signal obtained with the phase shift set by the control circuit 118-2 is supplied to the receiver circuit 117-2. Then, each of the receiver circuits 117-1 and 117-2 performs the correlation detection so that the received signals are reproduced.

Since the second intermediate-frequency signals are not successively input to the reception circuits 117-1 and 117-2, the signal subjected to the correlation detection somewhat deteriorates. As a result, the detection sensitivity somewhat deteriorates. If the plural wireless units existing in different directions are sufficiently near the active array antenna system, the signals transmitted from the wireless units can be received by sharing the radio frequency circuit. As a result, an effect can be obtained in that the capacity of subscribers of the wireless communication system can be enlarged.

When a structure similar to the second embodiment shown in FIG. 11 is employed wherein also the gain is controlled as well as the phase shift, the controllability of the directional pattern and performance including suppression of interference wave can be improved.

Fifth Embodiment

Figure 17:
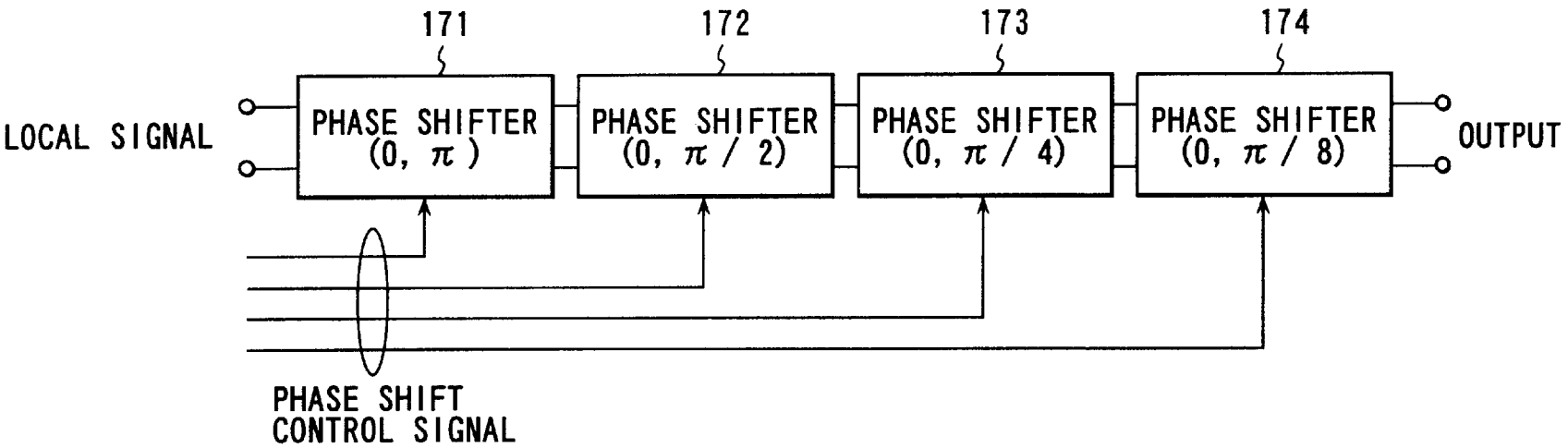
FIG. 17 is a block diagram showing an example of a digital control phase shifter which constitutes the variable phase shifter circuit of the active array antenna system according to a fifth embodiment of the present invention.

Referring to FIG. 17, the structure of the variable phase shifter circuit 113 for use in a fifth embodiment of the active array antenna system according to the present invention will now be described. The overall structure of the fifth embodiment is the same as that of the first to fourth embodiments.

In general, the variable phase shifter circuit 113 for shifting the phase of the intermediate-frequency local signal has a low level. Therefore, conditions of noise and distortion can be moderated as compared with the received RF signal having the phase or the amplitude provided with information and the variable phase shifter circuit for shifting the phase of the carrier-wave frequency local signal in the conventional active array antenna system. Therefore, a various phase shifter circuits may be employed as the variable phase shifter circuit 113 as well as the structure comprising the quadrature modulator shown in FIG. 2. The variable phase shifter circuit 113 can be realized by an n-bit digital control phase shifter (n is an arbitrary natural number) composed of low-cost silicon integrated circuits.

FIG. 17 shows a portion of the variable phase shifter circuit 113 which corresponds to one element antenna 101. The foregoing circuit constitutes a 4-bit digital control phase shifter. The 4-bit digital control phase shifter has a concatenation of a 0 or $\pi$ phase shifter 171, a 0 or $\pi/2$ phase shifter 172, a 0 or $\pi/4$ phase shifter 173 and a 0 or $\pi/8$ phase shifter 174.

The phase shift of each of the phase shifters 171 to 174 is controlled in response to the phase shift control signal supplied from the control circuit 118, for example, as shown in FIG. 1. As a result of the foregoing structure, the phase of the intermediate-frequency local signal can be varied to 16 steps in a range from 0 to $15\times(\pi/8)$ in steps of $\pi/8$. The variable phase shifter circuit 113 must be N four-bit digital control phase shifters shown in FIG. 17, N being the number of the element antennas 101.

If a 5-bit or 6-bit digital control phase shifter which is capable of varying the phase shift to a larger number of steps is required, a 0 or $\pi/16$ phase shifter and 0 or $\pi/32$ phase shifter may be added to the structure shown in FIG. 17.

Sixth Embodiment

Figure 18:
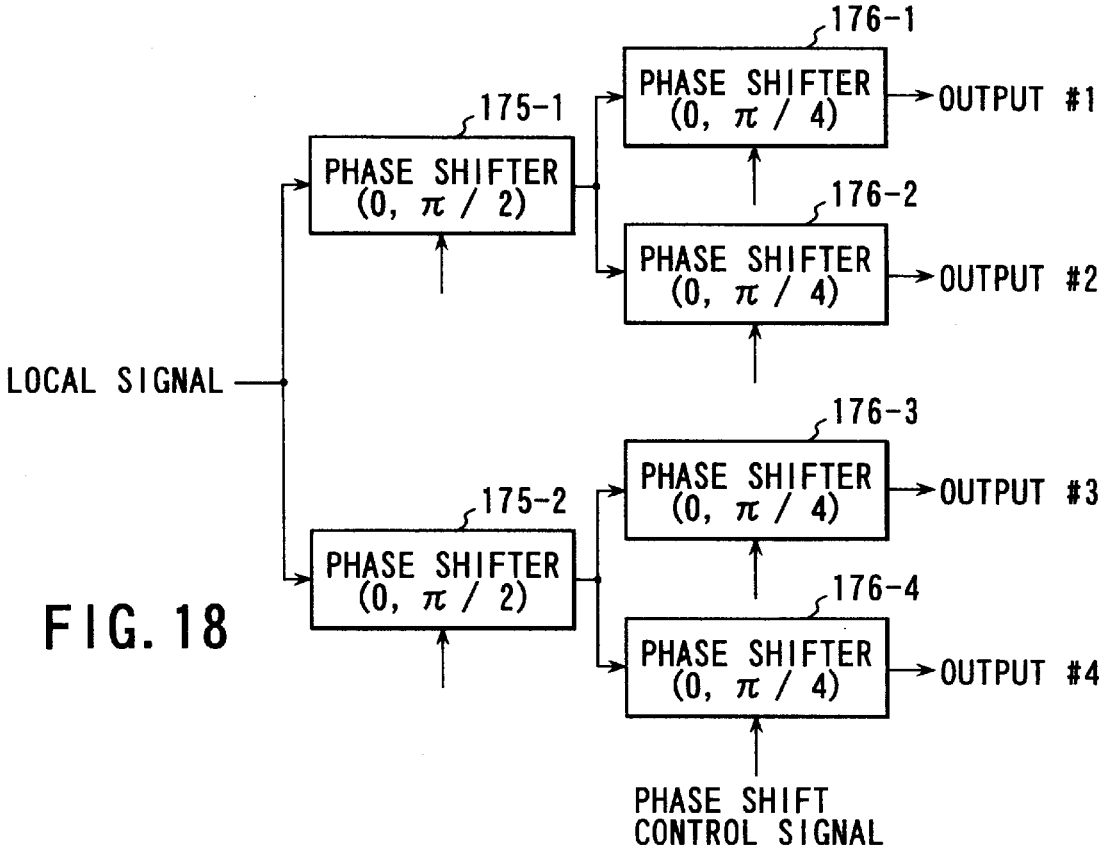
FIG. 18 is a block diagram showing another example of the digital control phase shifter which constitutes the variable phase shifter circuit of the active array antenna system according to a sixth embodiment of the present invention.

Referring to FIG. 18, the structure of the variable phase shifter circuit 113 for use in a sixth embodiment of the active array antenna system according to the present invention will now be described. Also the overall structure of the sixth embodiment is the same as that according to the first to fourth embodiments.

When the digital control phase shifter having the structure as shown in FIG. 17 is provided for each element antenna 101 to constitute the variable phase shifter circuit 113, the degree of freedom of the beam pattern is widened. However, the total number of the phase shifters 171 to 174 is enlarged. As a result, power consumption in the amplifying circuit in the signal selection circuit (to be described later) included in each of the phase shifters 171 to 174 is enlarged. If the 0 or $\pi/2$ phase shifters 175-1 and 175-2 and the 0 or $\pi/4$ phase shifters 176-1 to 176-4 are connected to one another to form a tree structure, the degree of freedom of the beam pattern is narrowed. However, the number of the required phase shifters can be reduced. FIG. 17 shows four phase shifters for each of the element antenna, but FIG. 18 shows six phase shifters for all of the element antennas. Thus, power consumption can be reduced. The phase shifts of the phase shifters 175-1, 175-2, 176-1 and 176-4 shown in FIG. 18 are controlled in response to the phase shift control signal supplied from the control circuit 118 shown in FIG. 1. The values of phase shift angle are not limited to $\pi/2$ and $\pi/4$, but may be changed to a desired values.

Figure 19:
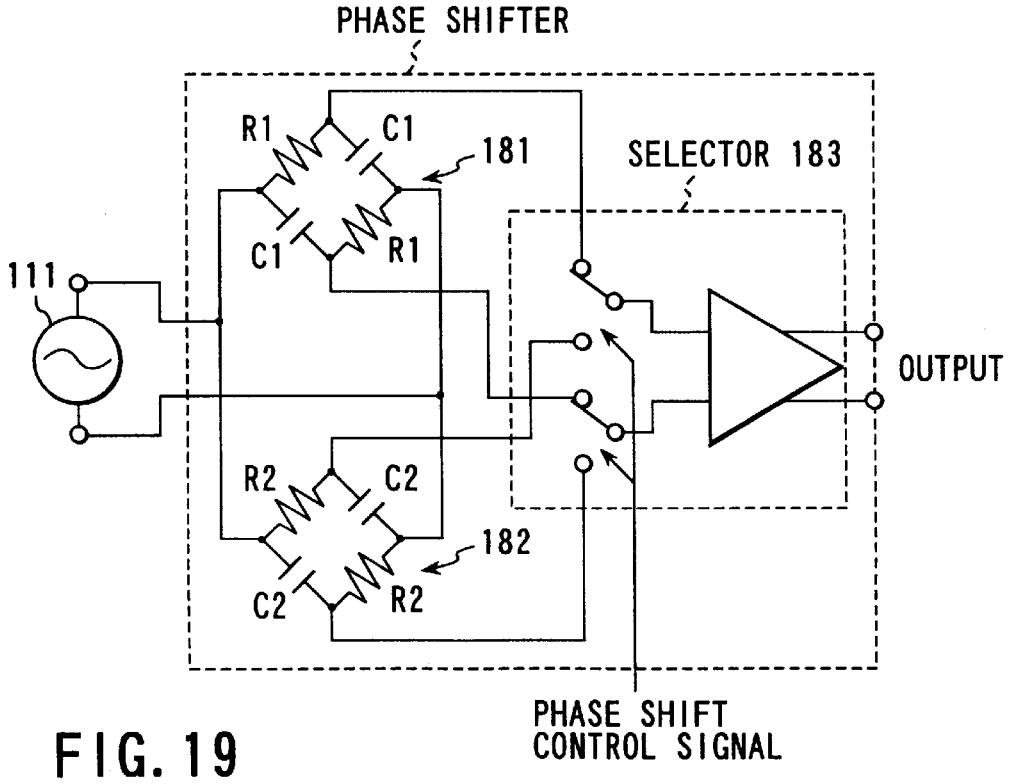
FIG. 19 is a circuit diagram showing the specific structure of a phase shifter according to the fifth and sixth embodiments.

FIG. 19 shows an example of the phase shifter for use in the digital control phase shifter shown in FIGS. 17 and 18. The local signal supplied from the intermediate-frequency local signal generator 111 is a differential signal which is supplied to two bridge circuits 181 and 182. The bridge circuit 181 comprises two resistors R1 and two capacitors C1 disposed on the opposite sides. Also the bridge circuit 182 similarly comprises two resistors R2 and two capacitors C2 disposed on the opposite sides. As disclosed in, for example, Japanese Patent Application No. 9-3949, the frequency with which the phase difference (the phase shift) between the input and output of the bridge circuits 181 and 182 is 90° ($\pi/2$ radian) is determined by the product of the resistance of the resistors constituting the bridge circuits and the capacitances of the capacitors.

When the values of R1, R2, C1 and C2 are selected to make phase shift of the bridge circuit 181 to be $\pi/2-\pi/8$ and the phase shift of the bridge circuit 182 to be $\pi/2+\pi/8$, the phase shift is switched by $\pi/4$ (=45°) by the selector 183. Therefore, the foregoing structure can be considered as the 0 or $\pi/2$ phase shifter. Also the 0 or $\pi/8$ phase shifter and the 0 or $\pi/4$ phase shifter can be realized by similar structures. As for the 0 or $\pi$ phase shifter, the structure must be formed such that R1=0, C1=0, R2=$\infty$ and C2=$\infty$. When R1 and C1 are short-circuited and R2 and C2 are opened, the foregoing phase shifter can be realized.

When the variable phase shifter circuit 113 is commonly used as in the TDD system to perform transmission and reception as described later, the phase shift of the variable phase shifter circuit 113 must be determined to make the phase of the intermediate-frequency local signal to be complex conjugate between the transmission side and the reception side. When the n-bit digital control phase shifter constitutes the variable phase shifter circuit 113 as is employed in this embodiment, bit inversion of the phase shift control signal (the digital signal) between the transmission side and the reception side is performed. Thus, the phases of the intermediate-frequency local signal can be made to satisfy the complex conjugate between the transmission side and the reception side.

Seventh Embodiment

Figure 20:
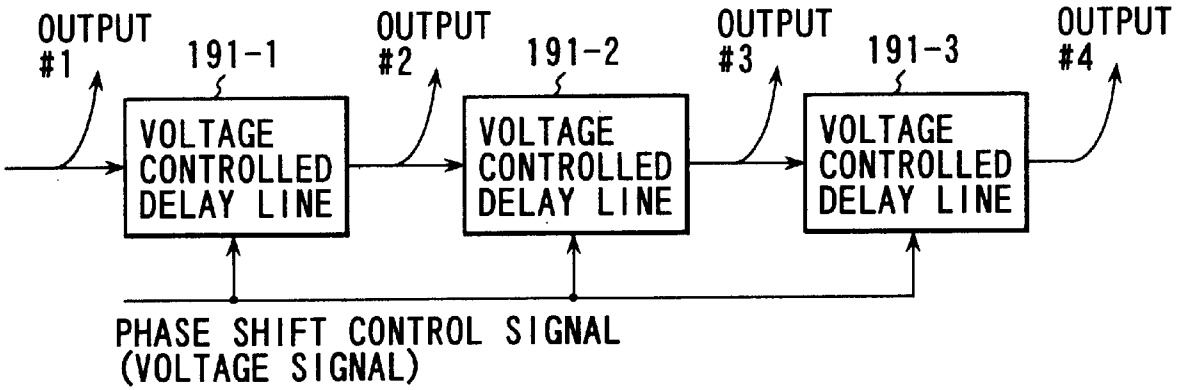
FIG. 20 is a block diagram showing the structure of the variable phase shifter circuit constituted by a voltage controlled delay line of an active array antenna system according to a seventh embodiment of the present invention.
Figure 21:
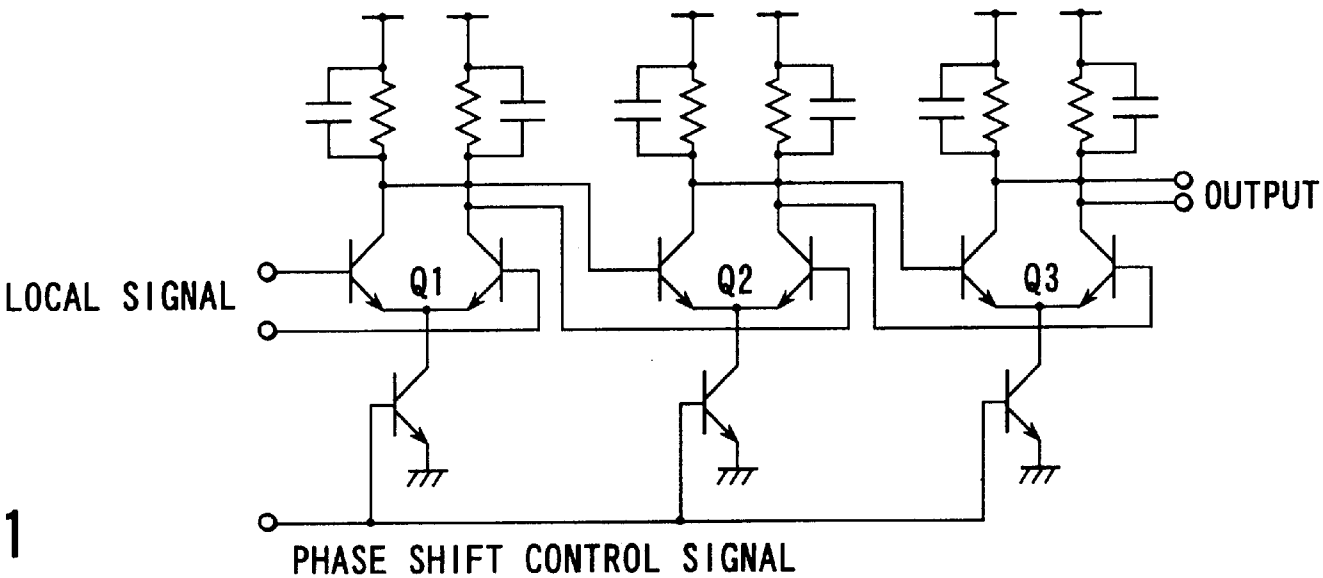
FIG. 21 is a circuit diagram showing an example of the specific structure of the voltage controlled delay line shown in FIG. 20.
Figure 22:
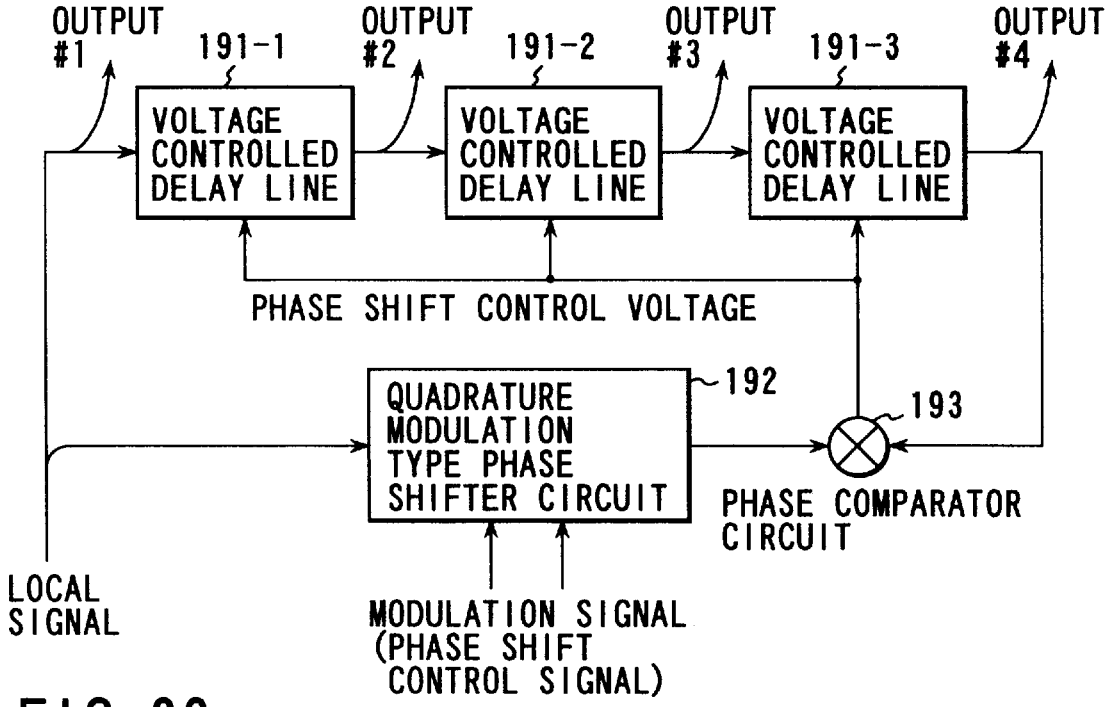
FIG. 22 is a block diagram showing an example of the control voltage generator which is combined with the variable phase shifter circuit according to the seventh embodiment.

Referring to FIGS. 20 to 22, the structure of the variable phase shifter circuit 113 for use in a seventh embodiment of the active array antenna system according to the present invention will now be described. Also the overall structure of the seventh embodiment is the same as that according to the first to fourth embodiments.

The variable phase shifter circuit 113 according to this embodiment is constituted by a voltage controlled delay line having a quantity of delay which is varied by the controlled voltage. A method is known wherein a delay line having a fixed delay time is used to vary the frequency so as to scan the antenna beam. The active array antenna system according to the first to fourth embodiments controls the phase of the intermediate-frequency local signal. Therefore, distortion and noise conditions which must be satisfied by the delay line can be moderated as compared with the RF phase shifting method. As a result, a delay circuit having the quantity of delay which is somewhat varied electrically by the voltage or the like can be employed.

FIG. 20 is a diagram showing the basic structure of the variable phase shifter circuit 113 according to this embodiment, wherein concatenation of a plurality of voltage controlled delay lines 191-1 to 191-3 is formed. In the foregoing case, the voltage controlled delay lines 191-1 to 191-3 are able to have substantially the same characteristics by using integrated circuits. As a result, signals having the phase differences at the same intervals can be formed. The quantity of delay of each of the voltage controlled delay lines 191-1 to 191-3 can be changed in accordance with the phase control voltage in a range across a delay of about one wavelength. Thus, the direction of the antenna beam can be controlled. The number of concatenation of the voltage controlled delay lines is not limited to three. The number may be enlarged, if necessary.

FIG. 21 shows an example of the specific structure of the voltage controlled delay lines 191-1 to 191-3. Each of the voltage controlled delay lines 191-1 to 191-3 comprises a multi-stage difference amplifying circuits in the form of concatenation of a plurality of differential transistor pairs Q1 to Q3. In general, the difference amplifying circuit acts as an amplitude limiter circuit when a signal having a large amplitude is supplied so that its output is clipped. Thus, a square waveform signal is generated. The phase of the square waveform signal varies depending on a bias current of each of the differential transistor pairs Q1 to Q3. When a current source connected to a common emitter for the differential transistor pairs Q1 to Q3 is controlled in response to the phase shift control signal (the control voltage) to change the bias current as shown in FIG. 21, the phase shift can be controlled.

If the bias current is constant, a structure wherein a load circuit for each of the differential transistor pairs Q1 to Q3 is constituted by a capacitor enables the phase shift to be controlled by changing the phase of the square waveform signal with the time constant of the capacitor. If the frequency of the signal is high, a required quantity of delay can sometimes be obtained by only the parasitic capacity of the collector of the transistor without special use of the capacitor provided for the load circuit as shown in FIG. 21.

In actual, the delay time of one wavelength cannot be realized by a single differential transistor. Therefore, the structure shown in FIG. 21 comprises the plurality of the differential transistor pairs Q1 to Q3 in the form of the concatenation. Thus, a required delay time and a required delay time range can be obtained.

FIG. 22 shows an example of the phase shift control voltage generator for generating phase shift control voltage which is supplied to the voltage controlled delay lines 191-1 to 191-3. As shown in FIG. 22, the phase shift control voltage generator comprises a quadrature modulation type phase shifter circuit 192 and a phase comparator circuit 193 for generating the voltage corresponding to the phase difference between the output signal of one voltage controlled delay line 191-3 as a phase shift control voltage and the local input signal. The phase shift control voltage generator performs feedback control. Although the relationship between the phase shift and the phase shift control voltage can accurately be designed, the quadrature modulation type phase shifter circuit 192 is able to relatively accurately control the phase shift. Therefore, in this embodiment, the feedback control using the phase shift of the quadrature modulation type phase shifter circuit 192 as a reference is performed so that the overall phase shift of the variable phase shifter circuit 113 is accurately controlled.

Figure 23:
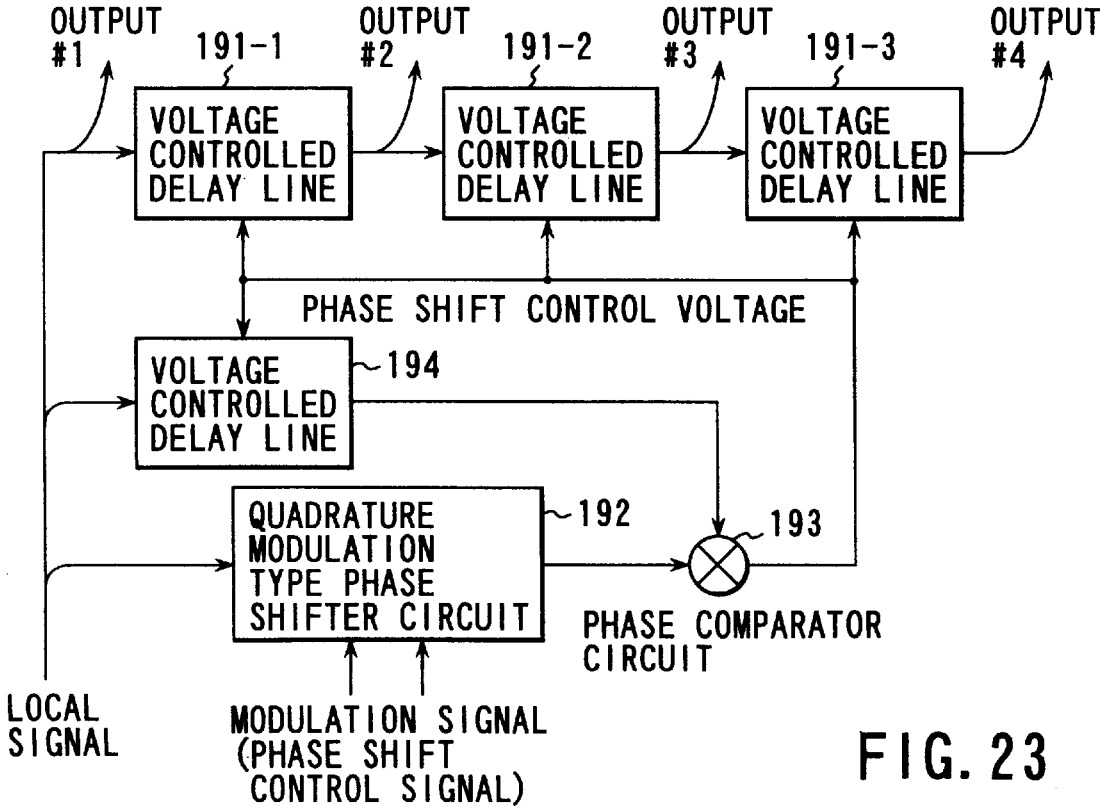
FIG. 23 is a block diagram showing another example of the control voltage generator which is combined with the variable phase shifter circuit according to the seventh embodiment.

FIG. 23 shows another example of the phase shift control voltage generator. When a signal allowed to pass through the plural voltage controlled delay lines 191-1 to 191-3 is compared with a reference phase signal as shown in FIG. 22, the phase of output #4 of a final circuit (the voltage controlled delay line 191-3) cannot easily be rotated by 360° or more.

On the other hand, the structure shown in FIG. 23 comprises a replica voltage control delay circuit 194 structured and controlled similar to the original voltage controlled delay lines 191-1 for determining the phase shift of the variable phase shifter circuit 113 is added. An output signal from the replica voltage control delay circuit 194 and the reference phase signal output from the quadrature modulation type phase shifter circuit 192 are compared with each other in the phase comparator circuit 193. Thus, as the quantity of delay obtained from each of the voltage controlled delay lines 191-1 to 191-3, a variable range of 360° can be realized. Therefore, the foregoing structure is effective when a great variation range of the phase shift is required.

The quadrature modulation type phase shifter circuit 192 shown in FIGS. 22 and 23 may be replaced with the digital control phase shifter shown in FIG. 17.

In each of the foregoing embodiments, the structure adaptable to the receiving active array antenna system may be applied to the transmitting active array antenna system. In the foregoing case, only the direction of the signals (electric waves) are inverted from that in the receiving active array antenna system. Thus, a similar effect can basically be obtained.

An example of a transmitting and receiving antenna system will now be described. Although the first to seventh embodiments are able to realize the transmitting antenna, the following description will be made on the basis of the first embodiment to prevent overlapping of the description.

Eighth Embodiment

Figure 24:
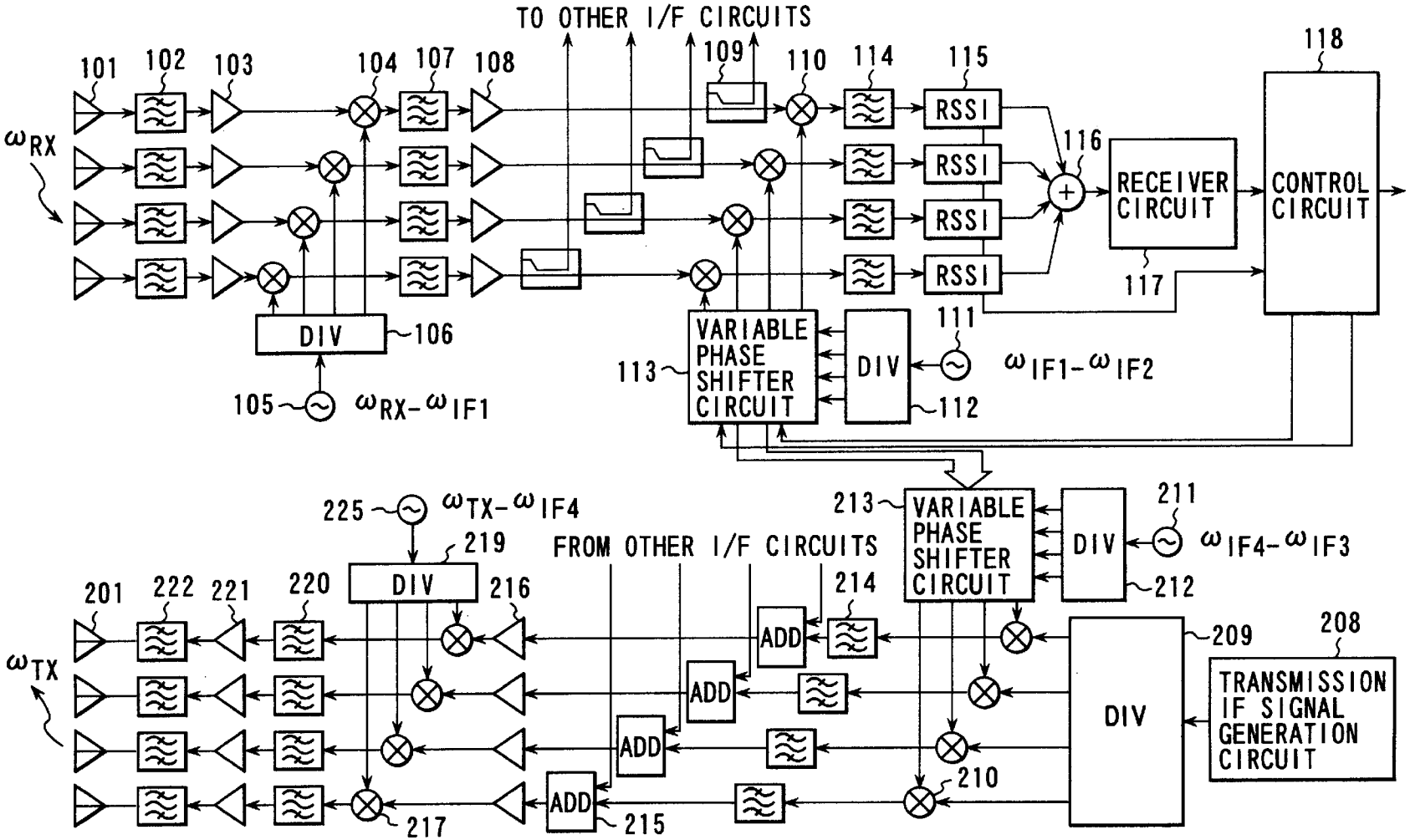
FIG. 24 is a block diagram showing the schematic structure of the active array antenna system of an eighth embodiment according to the present invention.

FIG. 24 shows the structure of an eighth embodiment of the active array antenna system according to the present invention. A wireless unit according to this embodiment comprises the active array antenna systems according to the first to seventh embodiment which are provided for the transmission and the reception. Moreover, variable phase shifter circuits for the intermediate-frequency local signal are employed as the radio frequency circuits for each of the transmission side and the reception side. Moreover, application to the TDD system is attempted to be realized by adding a circuit for inverting the sign of the phase shift control signal to the transmission side. Thus, a portion of the phase shift control signals is shared by the reception and transmission sides.

Referring to FIG. 24, the element antenna 101 is a transmission antenna and an element antenna 201 is a transmission antenna. The element antennas 101 and 201 are connected to the radio frequency circuits. The radio frequency circuit is composed of a reception radio frequency circuit connected to the reception element antenna 101 and a transmission radio frequency circuit connected to the transmission element antenna 201.

As described with reference to FIG. 1, the reception radio frequency circuit comprises the RF filter 102, the low-noise amplifier 103, the first frequency converter 104, the local signal generator 105, the divider 106, the band pass filter 107, the amplifier 108, the coupler 109, the second frequency converter 110, the intermediate-frequency local signal generator 111, the divider 112, the variable phase shifter circuit 113, the band pass filter 114, the RSSI circuit 115, the adder 116, the receiver circuit 117 and the control circuit 118.

When the radio frequency circuit from the transmission element antenna 101 to the amplifier 108 is shared by a plurality of intermediate-frequency circuits to simultaneously form the quadrature beams, the coupler 109 divides the output signal from the amplifier 108 to other intermediate-frequency circuits.

The transmission radio frequency circuit will now be described. A signal to be transmitted and having the second intermediate-frequency is generated by a transmission IF signal generator 208, and then divided into N (N=4 in the drawing) by a transmission IF signal divider 209. Then, the signal which must be transmitted is supplied to the intermediate-frequency circuit so that the frequency is converted from the second intermediate-frequency to the first intermediate-frequency by a second frequency converting circuit 210. The second frequency converting circuit 210 has been supplied with the intermediate-frequency local signal from an intermediate-frequency local signal generator 211 through a local signal divider 212 and a variable phase shifter circuit 213.

The variable phase shifter circuit 213 is a circuit for imparting a predetermined phase shift to the intermediate-frequency local signal output from the intermediate-frequency local signal generator 211 and divided by the local signal divider 212. The specific structure will be described later. The intermediate-frequency signal output from the second frequency converting circuit 210 is supplied to the band pass filter 214 so that only a predetermined frequency component is extracted.

When the radio frequency circuit from the amplifier 216 to the transmission element antenna 201 is shared by a plurality of intermediate-frequency circuits to simultaneously form the quadrature beams, the outputs (the outputs of the band pass filters 214) of the other intermediate-frequency circuits are added by the adder 215.

The first intermediate-frequency signal extracted through the adder 215 is amplified by the amplifier 216, and then the frequency is converted from the intermediate frequency to the carrier-wave frequency band by a first frequency converting circuit 217. The first frequency converting circuit 217 has been supplied with the carrier-wave frequency local signal obtained from the output from the carrier-wave frequency local signal generator 225 and divided by a local signal divider 219.

The RF signal in the carrier-wave frequency band output from the first frequency converting circuit 217 is supplied to the transmission element antenna 201 through a band pass filter 220, a transmission amplifier 221 and an RF filter 222.

The variable phase shifter circuits 113 and 213 may have any one of the structures according to the first to seventh embodiments. For example, each of the variable phase shifter circuits 113 and 213 has the structure, for example, as shown in FIGS. 2, 17, 18 and 20. The phase shift control signal has been supplied from the variable phase shifter circuit 113 in the reception radio frequency circuit to the variable phase shifter circuit 213 in the transmission radio frequency circuit. That is, the phase shift control signal is shared by the variable phase shifter circuits 113 and 213 of the reception and transmission radio frequency circuits.

Figure 25:
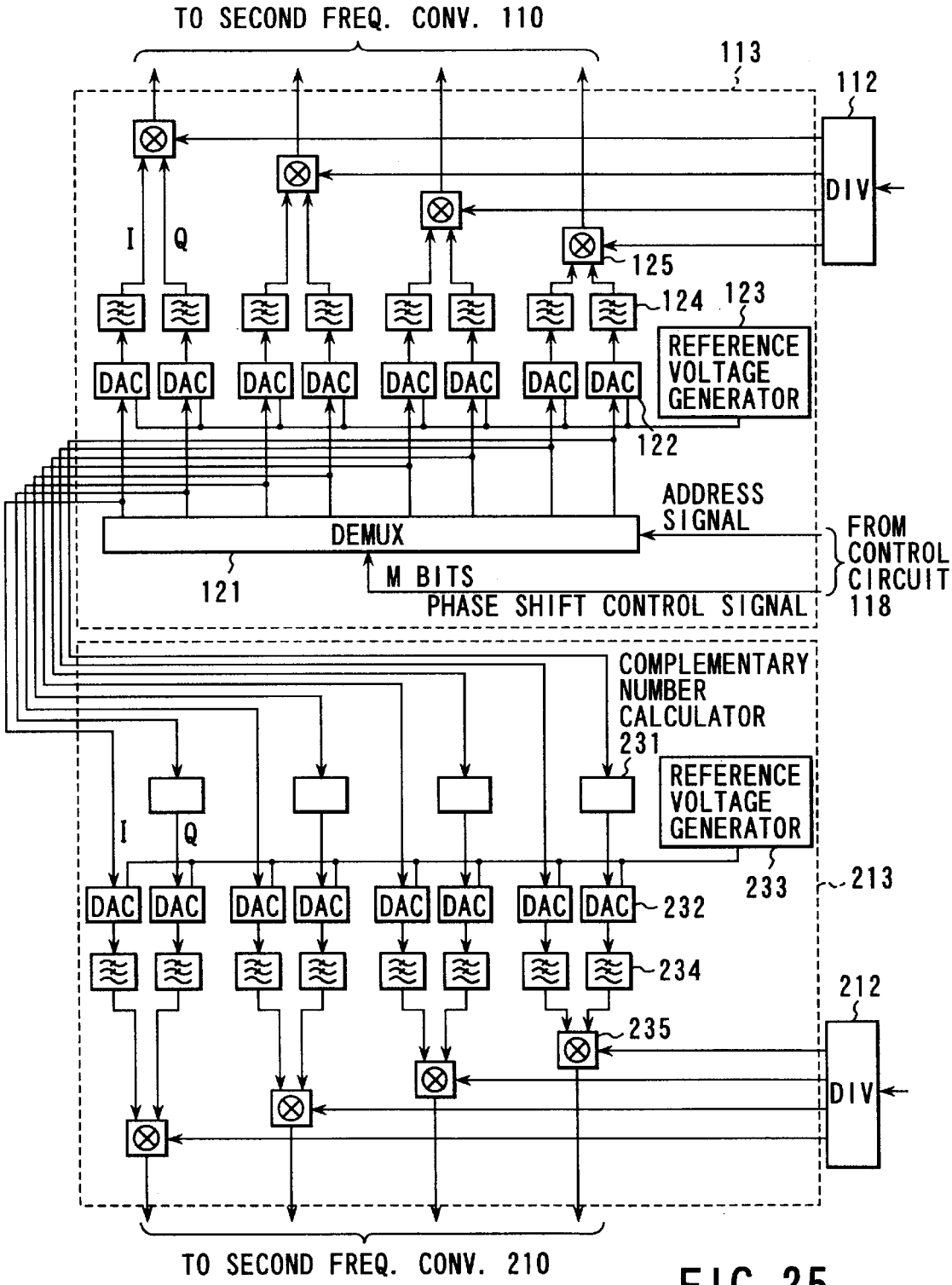
FIG. 25 is a block diagram showing the structure of the variable phase shifter circuit and a gain control circuit according to the eighth embodiment.

FIG. 25 is a diagram showing the structures of the variable phase shifter circuits 113 and 213 shown in FIG. 24. The reception variable phase shifter circuit 113 has the basic structure as described with reference to FIG. 2. Thus, the reception variable phase shifter circuit 113 comprises the demultiplexer 121, the D/A converters 122, the reference voltage generator 123, the low pass filters 124 and the quadrature modulators 125. On the other hand, the transmission variable phase shifter circuit 213 comprise complement number calculators 231, D/A converters 232, a reference voltage generator 233, low pass filters 234 and quadrature modulators 235.

The variable phase shifter circuit 213 in the transmission radio frequency circuit has been supplied with the phase shift control signal divided from the demultiplexer 121 in the variable phase shifter circuit 113 in the reception radio frequency circuit. The phase shift of the intermediate-frequency local signal is determined such that the phase of the intermediate-frequency local signal is made to be complex conjugate between the transmission radio frequency circuit and the reception radio frequency circuit. In this embodiment, a signal among the phase shift control signal output from the demultiplexer 121 which corresponds to the input of the channel Q of the quadrature modulator 125 in the variable phase shifter circuit 113 of the reception radio frequency circuit is supplied to the variable phase shifter circuit 213 of the transmission radio frequency circuit. The foregoing signal is supplied to the D/A converter 232 through the complement number calculator 231. Thus, inversion of the sign is performed between that of the digital value of the phase shift control signal Q, which is supplied to the D/A converters 122 in the variable phase shifter circuit 113 of the reception radio frequency circuit, and that of the digital value of the phase shift control signal which is supplied to the D/A converter 232 in the variable phase shifter circuit 213 of the reception and transmission radio frequency circuit.

On the other hand, a signal among the phase shift control signals output from the demultiplexer 121 in the variable phase shifter circuit 113 of the reception radio frequency circuit, which corresponds to the input of the channel I of the quadrature modulator 125 is as it is supplied to the D/A converter 232 in the variable phase shifter circuit 213 of the transmission radio frequency circuit. As a result, the phase shift control signal which is supplied to the reception and transmission variable phase shifter circuits 113 and 213 can be shared. Thus, an effect can be obtained in that the structure of the circuit can be simplified.

Figure 26:
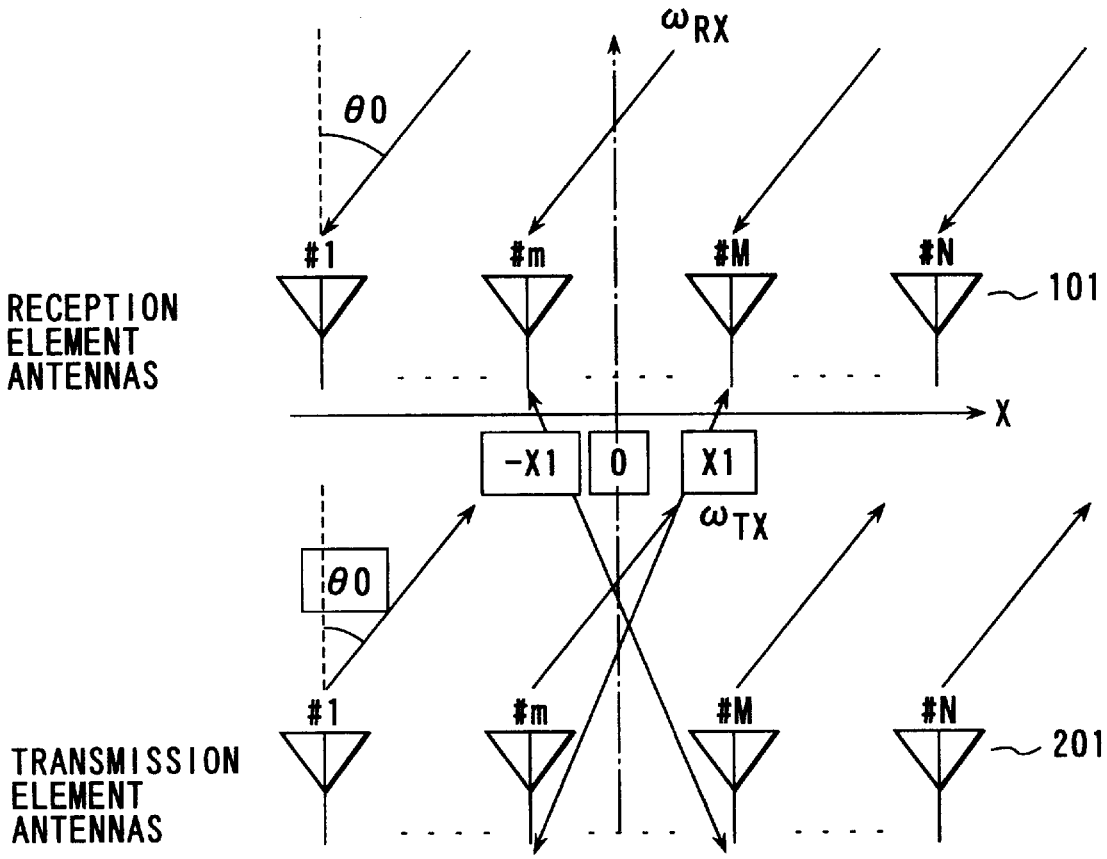
FIG. 26 is a diagram showing the layout of transmission element antennas and reception element antennas according to the eighth embodiment.

FIG. 26 shows an example of the layout of the transmission element antennas 101 and the transmission element antennas 201 according to this embodiment. An electromagnetic wave made incident on each of the transmission element antennas 101 with a certain angle and having an angular frequency of $\omega_{RX}$ is received by each of the transmission element antennas 101 (#1 to #N) (N is an integer not smaller than 2) with a phase difference corresponding to the incident angle. Among the reception element antennas 101, element antennas #M and #m (M and m are integers satisfying $1 \leqq M$ and $m \leqq N$) disposed symmetrically with respect to the center of the antennas are paid attention.

It is assumed that a front direction is axis Z having the original at the center of the antennas and the electromagnetic wave is made incident from a direction $\theta_0$. Assuming that the coordinates of the positions of the reception antennas #M and #m are $X_I$ and $-X_I$, the reception phase of the reception element antenna #M is advanced by $\phi_M = k_0 X_I \sin\theta_0$ with respect to the center of the antennas. On the other hand, the reception phase of the reception element antenna #m is advanced by $\phi_m = -k_0 X_I \sin\theta_0 = -\phi_M$ with respect to the center of the antennas. Note that $k_0$ is the number of waves in a free space which is expressed as $k_0 = 2\pi\omega_{RX}$. Therefore, the reception phase differences of the reception element antennas #M and #m with respect to the center of the antennas have the complex conjugate relationship. The RF signal received by the transmission element antenna 101 (#1 to #N) is converted into the first intermediate-frequency signal having the angular frequency of $\omega_{IF1}$ in the first frequency converter 104 by using the carrier-wave frequency local signal having the angular frequency $(\omega_{RX} - \omega_{IF1})$. At this time, the relative reception phase direction of each transmission element antenna 101 with respect to the center of the antennas is maintained.

The signals received by the reception element antennas #M and #m are expressed as $A_M \sin(\omega_{IF1} t + \phi_M)$ and $A_m$ $\sin(\omega_{IF1}t+\phi_m)=A_m \sin(\omega_{IF1}t-\phi_M)$(where t is time). The first intermediate-frequency signal is converted to the second intermediate-frequency $\omega_{IF2}$ by the second frequency converter 110.

At this time, the phase of the intermediate-frequency local signal which is supplied to the second frequency converter 110 and which has an angular frequency of $(\omega_{IF1}-\omega_{IF2})$ is controlled by the variable phase shifter circuit 113. Thus, the reception phase differences of the transmission element antennas 101 can be corrected. Specifically, the phase of the second intermediate-frequency signal with respect to the signal received by the element antenna #M is advanced by $+\phi_M$. Moreover, the phase of the second intermediate-frequency signal with respect to the signal received by the element antenna #m is advanced by $+\phi_m=-\phi_M$. Thus, the phases of all of the second intermediate-frequency signals can be made to be the same. The operation of the second frequency converter 110 is expressed by the following equation:

$$A_M \sin(\omega_{IF1}t+\phi_M)\times B \sin\{(\omega_{IF1}-\omega_{IF2})t+\phi_M\}\rightarrow C_M A_M B \sin(\omega_{IF2}t) \quad (2)$$

$$A_m \sin(\omega_{IF1}t+\phi_m)\times B \sin\{(\omega_{IF1}-\omega_{IF2})t+\phi_m\}=A_m \sin(\omega_{IF1}t-\phi_M)\times B \sin\{(\omega_{IF1}-\omega_{IF2})t-\phi_M\}\rightarrow C_m A_m B \sin(\omega_{IF2}t) \quad (3)$$

wherein $C_M$ and $C_m$ are constant coefficients.

Thus, the phases of the second intermediate-frequency signals output from the second frequency converters 110 are made to be the same and added to one another by the adder 116 so as to be transmitted to the receiver circuit 117.

In the transmission side, the second intermediate-frequency signal $\omega_{IF3}$ is divided into N by the transmission IF signal divider 209 so as to be supplied to the second frequency converting circuit 210. At this time, the phase of the intermediate-frequency local signal having the angular frequency $(\omega_{IF4}-\omega_{IF3})$ which is supplied to the first frequency converting circuit 210 is controlled by the variable phase shifter circuit 213. Thus, the phases of the RF signals which must be transmitted to the transmission element antennas 201 can be made different to direct the transmission beams to a required direction while the transmission phase differences of the transmission element antennas 201 are being corrected.

To direct the transmission beams in the same direction wherein the received RF signals have been transmitted, the phases of the intermediate-frequency local signals for the transmission element antennas #M and #m must be advanced by $-\phi_M$ and $-\phi_m=\phi_M$. As a result, the phase difference can be imparted to the transmission RF signals as expressed by the following equations:

$$E_M \sin(\omega_{IF3}t)\times D_M \sin\{(\omega_{IF4}-\omega_{IF3})t-\phi_M\}$$
$$\rightarrow C_M' E_M D_M \sin(\omega_{IF4}t-\phi_M)\rightarrow C_M'' E_M D_M \sin(\omega_{TX}t-\phi_M) \quad (4)$$

$$E_m \sin(\omega_{IF3}t)\times D_m \sin\{(\omega_{IF4}-\omega_{IF3})t-\phi_m\}$$
$$=E_m \sin(\omega_{IF3}t)\times D_m \sin\{(\omega_{IF4}-\omega_{IF3})t-\phi_M\}$$
$$\rightarrow C_m' E_m D_m \sin(\omega_{IF4}t-\phi_m)=C_m' E_m D_m \sin(\omega_{IF4}t+\phi_M)$$
$$\rightarrow C_m'' E_m D_m \sin(\phi_{TX}t+\phi_M) \quad (5)$$

where $C_M'$, $C_m'$, $C_M''$ and $C_m''$ are constant coefficients

When the phase shifts of the intermediate-frequency local signals on the transmission side and the reception side in the variable phase shifter circuits 113 and 213 are compared with each other, the phase shifts have the conjugate relationship. Moreover, in each of the transmission element antenna 101 and the transmission element antenna 201, the phase shifts of the intermediate-frequency local signals corresponding to the element antennas #M and #m have the conjugate relationships.

Therefore, when the circuits having the same structures are employed in the transmission and reception variable phase shifter circuits 113 and 213, the following results can be obtained. That is, the phase shift of the transmission side intermediate-frequency local signal corresponding to the element antenna #M, that of the reception side intermediate-frequency local signal corresponding to the element antenna #m, that of the transmission side intermediate-frequency local signal corresponding to the element antenna #m and that of the reception side intermediate-frequency local signal corresponding to the element antenna #M coincide with one another. Thus, the same phase shift control signal can be employed.

As a result, the control circuit 118 is not required to generate different phase shift control signals between the transmission operation and the reception operation. That is, the same signal can be used. Moreover, the transmission operation and the reception operation can be performed by using the variable phase shifter circuits 113 and 213 having the same structures (note that the channel Q phase shift control signal is supplied to the complement calculating circuit). As a result, the number of parts can be reduced. Thus, the overall cost of the active array antenna system and that of the wireless unit can be reduced.

In this embodiment, the linear array antenna system has been described wherein the element antennas #1 to #N are disposed on a straight line. The present invention is not limited to the foregoing structure. The structure of the present invention can be applied to a two dimensional array antenna system having the square arrangement or a triangular arrangement on a two dimensional plane.

In this embodiment, the phases of the intermediate-frequency local signals are controlled when the frequency is converted from the intermediate frequency $\omega_{IF1}$ to $\omega_{IF2}$ and from $\omega_{IF3}$ to $\omega_{IF4}$ by the frequency converter circuits 110 and 210. The present invention is not limited to the foregoing structure. The phases of the carrier-wave frequency local signal may be controlled when the conversion of the frequency is performed by the first frequency converters 104 and 217 from the carrier-wave frequency $\omega_{RX}$ of the reception RF signal to the first intermediate-frequency $\omega_{IF1}$ and that from the first intermediate-frequency signal $\omega_{IF4}$ to the carrier-wave frequency $\omega_{TX}$ of the transmission RF signal. Also the foregoing structure attains a similar effect.

Ninth Embodiment

Figure 27:
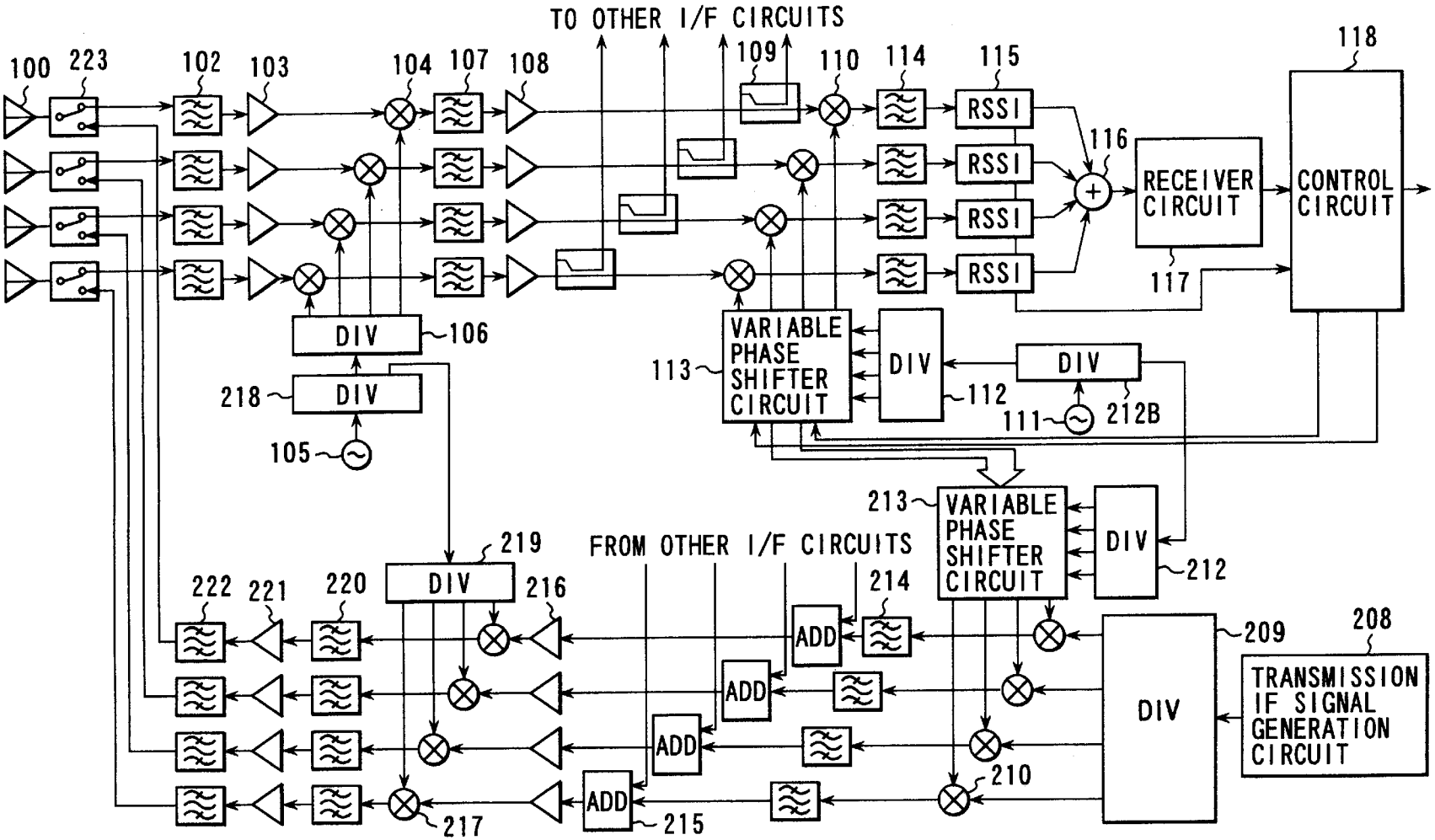
FIG. 27 is a block diagram showing another example of the control voltage generator which is combined with a variable phase shifter circuit according to a ninth embodiment of the present invention.

FIG. 27 shows the structure of a wireless unit according to a ninth embodiment of the present invention. The wireless unit according to this embodiment has the structure that the active array antenna system according to the first to seventh embodiments is commonly used in the transmission and the reception (the eighth embodiment uses individual active array antenna system for each of the transmission operation and the reception operation). Moreover, variable phase shifter circuits for the intermediate-frequency local signal are employed in the radio frequency circuits for the reception side and the transmission side. Moreover, this embodiment is structured to permit application to the TDD system by adding a circuit for inverting the sign of the phase shift control signal to the transmission side so as to share a portion of the phase shift control signal by the reception and transmission sides.

Referring to FIG. 27, the element antenna 100 is commonly used to perform reception and transmission. The element antenna 100 is connected to the radio frequency circuit through a transmission/reception RF switch 223. The radio frequency circuit is composed of a reception side radio frequency circuit and a transmission side radio frequency circuit which are selectively connected to the element antenna 100 through the transmission/reception switch 223.

As described with reference to FIG. 1, the reception side radio frequency circuit is composed of the RF filter 102, the low-noise amplifier 103, the first frequency converter 104, the local signal generator 105, the divider 106, the band pass filter 107, the amplifier 108, the coupler 109, the second frequency converter 110, the intermediate-frequency local signal generator 111, the divider 112, the variable phase shifter circuit 113, the band pass filter 114, the RSSI circuit 115, the adder 116, the receiver circuit 117 and the control circuit 118.

In this embodiment, a local signal divider 218 for dividing the carrier-wave frequency local signal to the transmission side radio frequency circuit and the reception side radio frequency circuit is disposed between the local signal generator 105 and the divider 106. Moreover, a local signal divider 212B for dividing the intermediate-frequency local signal to the reception side radio frequency circuit and the transmission side radio frequency circuit is disposed between the intermediate-frequency local signal generator 111 and the dividers 112 and 212.

The transmission side radio frequency circuit will now be described. The signal having the first intermediate-frequency signal which must be transmitted and which has been generated by the transmission IF signal generator 208 is divided into N sections (N=4 in the case shown in the drawing) by the transmission IF signal divider 209. Then, the divided signals are supplied to the intermediate-frequency circuits. Thus, the second frequency converting circuit 210 converts the frequency from the second intermediate-frequency to the first intermediate-frequency signal. The second frequency converting circuit 210 has been supplied with intermediate-frequency local signal from the intermediate-frequency local signal generator 111 through the local signal dividers 212B and 212 and the variable phase shifter circuit 213.

The variable phase shifter circuit 213 is a circuit for imparting a predetermined phase shift to the intermediate-frequency local signal obtained from the output of the intermediate-frequency local signal generator 111 and divided by the local signal dividers 212B and 212. The specific structure of the variable phase shifter circuit 213 is the same as that according to the eighth embodiment shown in FIG. 25, only a predetermined frequency component of the first intermediate-frequency signal output from the second frequency converting circuit 210 is extracted by the band pass filter 214.

When the radio frequency circuit from the element antenna 100 to the adder 215 are shared by a plurality of intermediate-frequency circuits to simultaneously form the quadrature beams, the output signal from the band pass filter 214 is added with those of other intermediate-frequency circuits by the adder 215.

The first intermediate-frequency signal added by the adder 215 is amplified by the amplifier 216. Then, the frequency of the intermediate-frequency signal is converted from the first intermediate-frequency to the carrier-wave frequency band by the first frequency converting circuit 217. The first frequency converting circuit 217 has been supplied with the carrier-wave frequency local signal obtained from the output of the local signal generator 105 and divided by the local signal dividers 218 and 219.

The RF signal in the carrier-wave frequency band output from the first frequency converting circuit 217 is supplied to the element antenna 100 through the band pass filter 220, the transmission amplifier 221, the RF filter 222 and the transmission/reception switch 223.

The variable phase shifter circuits 113 and 213 have the same structures as those according to the first to seventh embodiments. For example, the structures shown in FIGS. 2, 17, 18 and 20 are employed. A phase shift control signal has been supplied from the variable phase shifter circuit 113 in the reception side radio frequency circuit to the variable phase shifter circuit 213 in the transmission side radio frequency circuit. That is, the phase shift control signal is shared by the reception side and transmission side variable phase shifter circuits 113 and 213. Also the foregoing structure is the same as that according to the eighth embodiment and the detailed structure is omitted here.

Also the above-mentioned embodiment attains an effect similar to that obtainable from the eighth embodiment. In this embodiment, the transmission/reception switch 223 enables the element antenna 100 to be used in both of the transmission operation and the reception operation. If a state of transmission of electric waves is not considerably varied depending on the difference in the horizontal distances, individual element antennas may be used for the reception and the transmission. In this case, the individual element antennas are disposed such that the state of arrival of the electric waves are not considerably different between the element antennas and great electromagnetic coupling between the element antenna does not take place.

When the active array antenna system is applied to an FDD (Frequency Division Dual transmission) system, a duplexer or a filter may be employed in place of the transmission/reception switch 223.

In this embodiment, the phase shift control signal for the variable phase shifter circuits 113 and 213 for the reception side radio frequency circuit and the transmission side radio frequency circuit is shared to simplify the structure. When application to the FDD system is performed, the phase shift control signal to the variable phase shifter circuits 113 and 213 may be generated by another control circuit.

Tenth Embodiment

Figure 28:
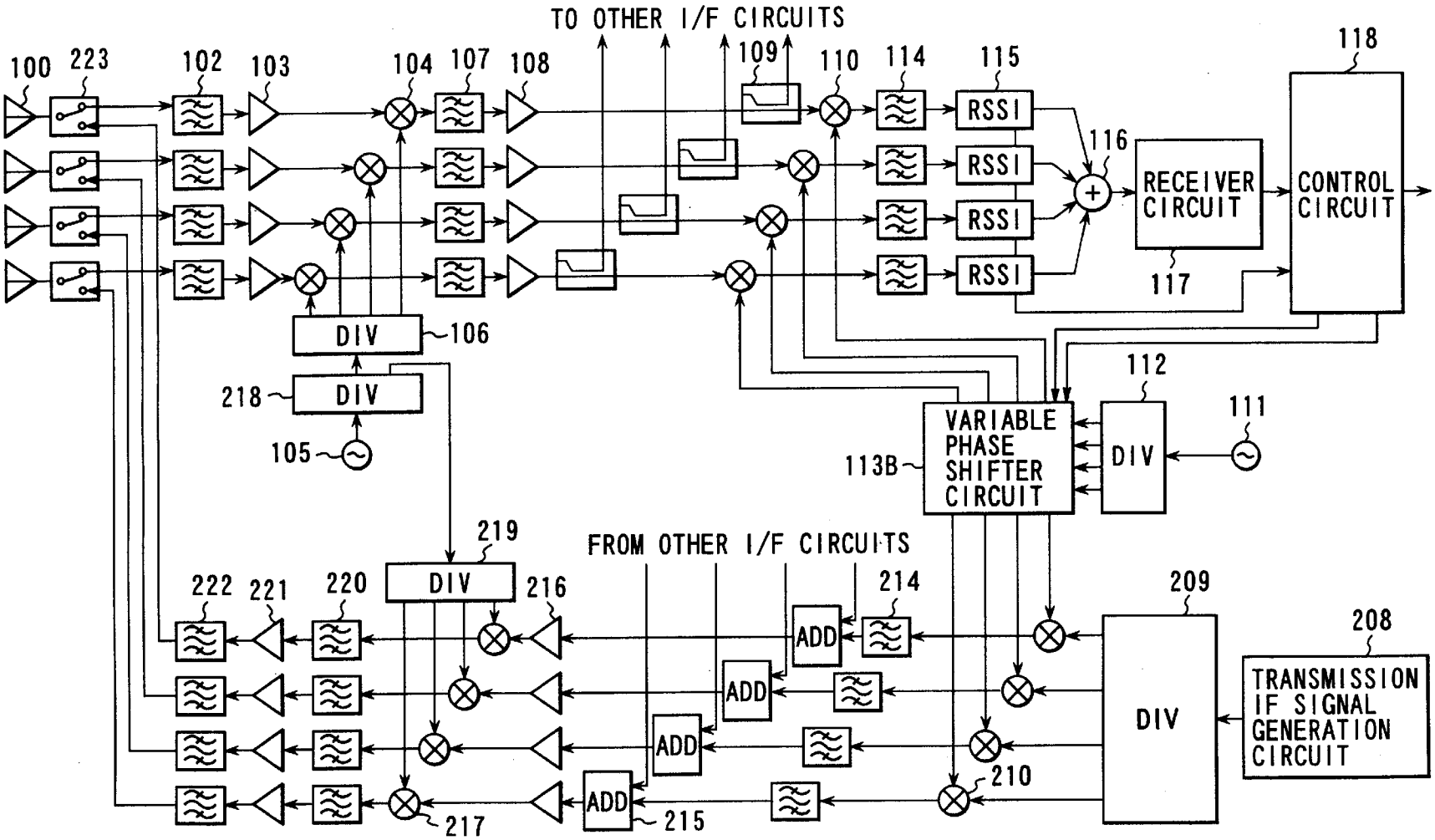
FIG. 28 is a block diagram showing the schematic structure of the active array antenna system of a tenth embodiment according to the present invention.

FIG. 28 shows the structure of an essential portion of a tenth embodiment of the active array antenna system according to the present invention. The tenth embodiment has a structure that the variable phase shifter circuit 113B for the intermediate-frequency local signal for the reception side and the transmission side radio frequency circuits according to the ninth embodiment shown in FIG. 27 is used commonly by the transmission side and the reception side. This embodiment is adaptable to the TDD (Time Division Dual transmission) system.

Figure 29:
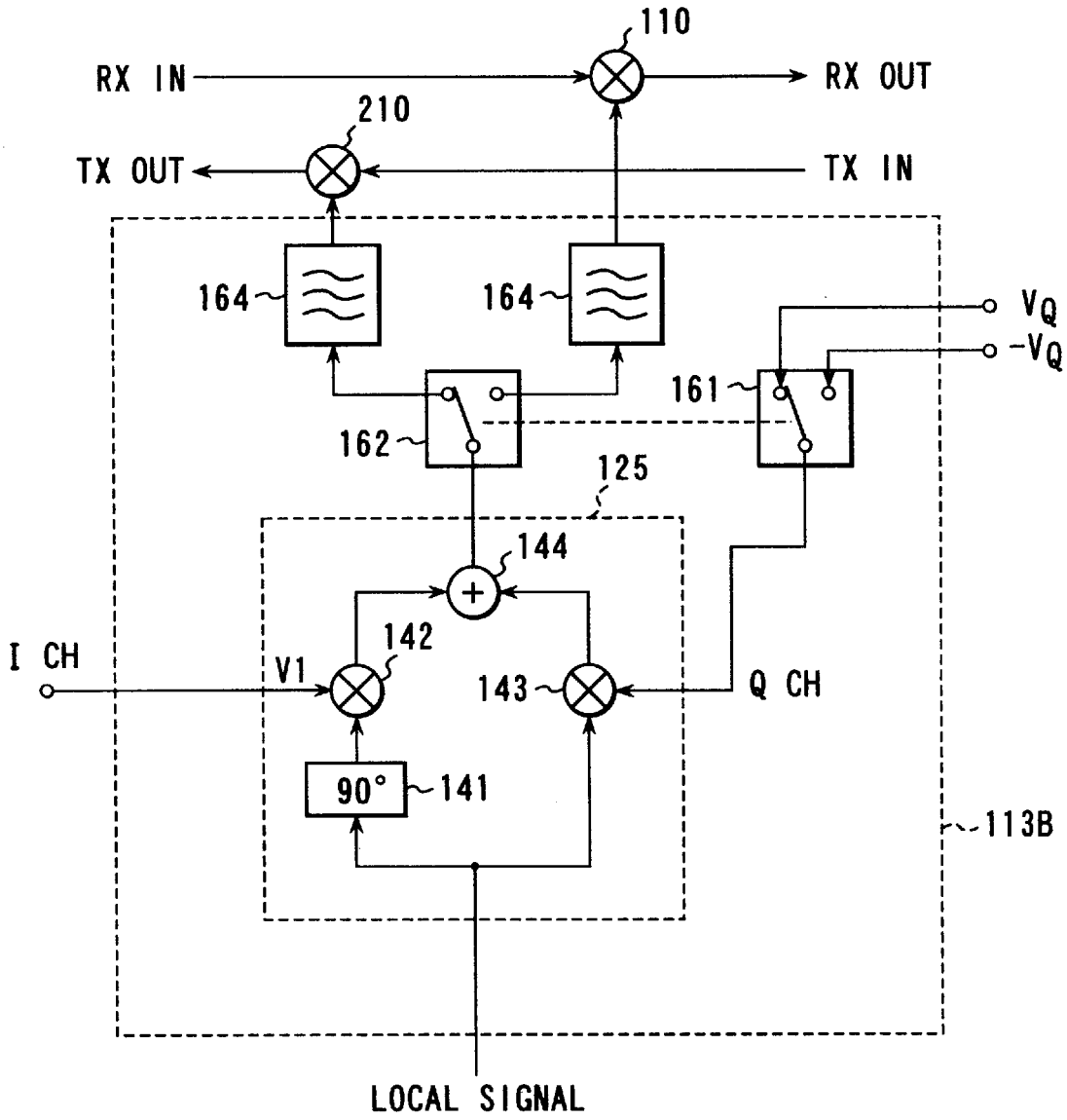
FIG. 29 is a block diagram showing the structure of an essential portion which is formed when the variable phase shifter circuit according to the tenth embodiment is used to perform both transmission and reception in a TDD system.

FIG. 29 is a block diagram showing the variable phase shifter circuit 113B. An output, the phase transition of which has been performed by the quadrature modulator 125, is selectively supplied to the second frequency converter 110 in the transmission side radio frequency circuit or the second frequency converting circuit 210 in the reception side radio frequency circuit through the switch 162.

The phases of the intermediate-frequency local signals must be complex conjugate between the transmission side radio frequency circuit and the reception side radio frequency circuit by determining the phase shift of the variable phase shifter circuit 113. A switch 161 arranged to be in synchronization with a switch 162 is operated to perform control such that the value of the input of the signal for controlling the channel Q when the reception is performed is made to be −VQ in a case where the value of the input of the signal for controlling the channel Q of the quadrature modulator 125 at the time of the transmission is VQ. The switches 161 and 162 may be realized by control circuits or software having a similar function.

Moreover, filters 163 and 164 are disposed between the switch 162 and the frequency converter circuits 110 and 210. The filters 163 and 164 arranged to remove harmonic spurious of the variable phase shifter circuit may be omitted from the structure.

As described above, this embodiment commonly uses the variable phase shifter circuit 113B. Therefore, the number of the required variable phase shifter circuits 113 in the overall active array antenna system can be reduced. Moreover, the phase shift control circuit system can be simplified. Therefore, the cost and size of the active array antenna system having the transmission and reception functions can be reduced.

Since the TDD system is structured to perform the transmission and reception by different time slots, the variable phase shifter circuit 113B can be used commonly if the transmission and reception frequencies are different from each other. In the foregoing case, the variable phase shifter circuit 113B must normally operate in the transmission and reception frequency range. In the foregoing case, the operation frequency range of the 90° phase shifter 141 in the quadrature modulator 125 must normally be operated among the units of the variable phase shifter circuit 113B. In general, 90° phase shifter accurately operates in a range of one octave. Therefore, no problem arises in a usual system.

According to the present invention, there is provided an active array antenna system comprising: a plurality of element antennas; and radio frequency circuits connected to the plural element antennas and comprising a frequency converting circuit provided for each element antenna and performing a frequency conversion by using an intermediate-frequency band local signal and a variable phase shifter circuit for individually controlling the phases of the intermediate-frequency band local signals which are supplied to the frequency converting circuits. Specifically, the frequency converting circuit comprises two types of frequency converting circuits: first frequency converters provided to correspond to the element antennas and convert the frequency between he carrier-wave frequency and a first intermediate-frequency by using the carrier-wave frequency band local signal and second frequency converters provided to correspond to the element antennas and convert the frequency between the first intermediate-frequency signal and the second intermediate-frequency by using the intermediate-frequency band local signal. The variable phase shifter circuit is used to individually control the phases of the intermediate-frequency band local signals which are supplied to the second frequency converters. As a result, the frequency which is processed in the variable phase shifter circuit can be lowered. Therefore, the variable phase shifter circuit can be realized at a low cost.

The frequency of the carrier-wave frequency band local signal which is supplied to the first frequency converter is made to be variable. Thus, communication can be performed by using a plurality of carrier-wave frequencies with a simple power supply system.

According to another aspect of the present invention, there is provided an active array antenna system having the radio frequency circuit which comprises plural frequency converting circuits provided to correspond to the element antennas and convert the frequency by using local signals and a variable phase shifter circuit for individually controlling the phases of the local signals which are supplied to the plural frequency converting circuits, wherein the variable phase shifter circuit includes a plurality of quadrature modulators provided to correspond to the element antennas, the quadrature modulator receives the local signal and a phase shift control signal. The variable phase shifter circuit comprising the quadrature modulator can be constituted at a low cost. Moreover, the phase shift can accurately be controlled. Therefore, accurate beam control can be performed in the active array antenna system.

In the foregoing case, the variable phase shifter circuit may have a low pass filter provided for the input portion of each of the plural quadrature modulators for receiving the phase shift control signal. A D/A converter may be provided for the input portion of each of the plural quadrature modulators for receiving the phase shift control signal and the same voltage is supplied to each D/A converter from a reference voltage generator.

The variable phase shifter circuit may comprise two bridge circuits receiving a local signal in the form of a differential signal and having two capacitors disposed on the two opposite sides and two resistors disposed on the other two opposite sides and arranged such that the resistance values of the capacitors and the resistors are different from one another and a plurality of phase shifter circuits composed of selectors for selectively outputting either output of the two bridge circuits in response to the phase shift control signal. The variable phase shifter circuit may comprise a plurality of variable delay circuits, the delay time each of which is controlled in response to the phase shift control signal.

The frequency of the local signal which is supplied to the variable phase shifter circuit may be made to be variable. When a channel is selected by using the variable frequency, the load which must be borne by a synthesizer for generating a frequency variable local signal in the carrier-wave frequency band can be reduced. Thus, the signal characteristics including SNR and CNR can be improved.

The radio frequency circuit may comprise a gain variable circuit provided to correspond to each element antenna. When the control of the amplitude of the signal is performed in addition to the control of the phase of the local signal, the directional pattern of the active array antenna system can variously be controlled. As a result, an interference wave suppression characteristic and the like can be improved.

The radio frequency circuit may comprise a divider for dividing a signal allowed to pass between the frequency converting circuit and the element antenna to the radio frequency circuit in another active array antenna system or an adder for adding the signal allowed to pass between the frequency converting circuit and the element antenna and a signal supplied from the radio frequency circuit in the other active array antenna system to each other. The divider and/or the adder is provided so that the frequency converting circuit for converting the phase between the carrier-wave frequency and the intermediate frequency by using the local signal in the carrier-wave frequency band and circuits across the frequency converting circuit may be shared by a plurality of active array antenna systems. Thus, a plurality of quadrature beams can simultaneously be formed with a low-cost structure.

The radio frequency circuit may be provided with both of a reception radio frequency circuit for receiving a received signal from the element antenna and a transmission radio frequency circuit for outputting a transmission signal to the element antenna. In the foregoing case, the variable phase shifter circuits of the transmission radio frequency circuit and the reception radio frequency circuit are controlled such that the phase shift is adjusted to make the phases of the output local signals to be complex conjugate with each other.

The variable phase shifter circuit has a structure that the period of the variable phase shifter circuit is smaller than the inverse of a transmission baud rate of a received signal or a transmission signal and the phase shift of the variable phase shifter circuit is varied in synchronization with a synchronization signal which varies at time intervals which are shorter than a time obtained by multiplying the inverse of the number of the received signals or the transmission signals and the inverse of the transmission baud rate of the received signal or the transmission signal, and the variable phase shifter circuit comprises a demultiplexer for dividing the received signal or the transmission signal at timing delayed from the synchronization signal by a predetermined time. Thus, reception from a plurality of wireless units existing in different directions or transmission to the plurality wireless units can be performed.

The active array antenna system having transmission and reception functions may have the element antenna which is commonly used to perform transmission and reception. The reception element antenna and the transmission element antenna may individually be provided. In the foregoing case, the reception radio frequency circuits for receiving the received signals from the reception element antennas and the variable phase shifter circuits in the transmission radio frequency circuits for outputting the transmission signals to the transmission element antennas commonly use the phase shift control signals corresponding to the transmission element antennas and the reception element antennas disposed symmetrically with one another with respect to the center of the antennas. Thus, the structure of the control circuit can be simplified.

Input frequency band $F_{in}$(min) to $F_{in}$(max) of the second frequency converting circuit, in particular, the frequency converting circuit (the second frequency converting circuit) for converting the frequency conversion by using the local signal in the intermediate-frequency band and frequency $F_{LO}$ of the local signal in the intermediate-frequency band satisfy the conditions that $F_{LO}<F_{in}(\min)/2$ and $F_{LO}<(F_{in}(\min)/(n+1))$ or $F_{LO}>(F_{in}(\max)/(n+1))$ regarding to all integers n which are not smaller than 2. Thus, a low-cost variable phase shifter circuit having a relatively low accuracy can be used to control the phases of the local signals. As a result, an accurate active array antenna system can easily be realized.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An active array antenna system comprising:

element antennas configured to receive carrier-wave frequency signals; and a radio frequency circuit connected to the element antennas and comprising first frequency converting circuits provided for each of said element antennas configured to perform a frequency conversion between the carrier-wave frequency signals and first intermediate-frequency signals by using first local signals, second frequency converting circuits provided for each of said element antennas and configured to perform a frequency conversion between the first intermediate-frequency signals and second intermediate-frequency signals by using second local signals, and a variable phase shifter circuit configured to shift phases of the plurality of second local signals.

2. The active array antenna system according to claim 1, wherein said variable phase shifter circuit shifts phases of each of the second local signals.

3. The active array antenna system according to claim 2, wherein said element antennas comprise at least three element antennas.

4. The active array antenna system according to claim 3, wherein said radio frequency circuit comprises a first local signal generator configured to generate the first local signals having a variable frequency.

5. The active array antenna system according to claim 3, further comprising:

gain control circuits configured to respectively control a gain of the first intermediate-frequency signals.

6. The active array antenna system according to claim 3, wherein an input frequency band $F_{in}$(min) to $F_{in}$(max) of each of said first frequency converting circuits and frequency $F_{LO}$ of the first local signals satisfy the conditions that $F_{LO}<F_{in}(\min)/2$ and $F_{LO}<(F_{in}(\min)/(n+1))$ or $F_{LO}>(F_{in}(\max)/(n+1))$ regarding to all integers n which are not smaller than two.

7. The active array antenna system according to claim 3, wherein said variable phase shifter circuit comprises a plurality of quadrature modulators provided to correspond to said element antennas and configured to receive the second local signals and a phase shift control signal.

8. The active array antenna system according to claim 3, wherein said variable phase shifter circuit comprises two bridge circuits configured to receive the second local signals in the form of a differential signal and having two capacitors disposed on two opposite sides and two resistors disposed on other two opposite sides, resistance values of the capacitors and the resistors being different from one another, and a selector configured to selectively output either output of the two bridge circuits in response to a phase shift control signal.

9. The active array antenna system according to claim 3, wherein said variable phase shifter circuit comprises a plurality of variable delay circuits configured to delay the second local signals, a delay time each of which is controlled in response to a phase shift control signal.

10. The active array antenna system according to claim 3, wherein said radio frequency circuit further comprises one of a divider for dividing the carrier-wave frequency signal allowed to pass between the first frequency converting circuit and the element antennas to the radio frequency circuit in another active array antenna system, and an adder for adding the carrier-wave frequency signal allowed to pass between the first frequency converting circuit and the element antennas and a carrier-wave frequency signal supplied from the radio frequency circuit in the other active array antenna system.

11. The active array antenna system according to claim 3, wherein a phase shift amount of said variable phase shifter circuit is controlled such that a period of the phase shift is smaller than an inverse of a transmission baud rate of a received signal or a transmission signal and the phase shift is varied in synchronization with a synchronization signal which varies at a time interval which is shorter than a time obtained by multiplying an inverse of the number of the received signals or the transmission signals and the inverse of the transmission baud rate of the received signal or the transmission signal, and said variable phase shifter circuit comprises a demultiplexer configured to divide the received signal or the transmission signal at timing delayed from the synchronization signal by a predetermined time.

12. The active array antenna system according to claim 3, wherein each of said second frequency converting circuits comprises a local signal generator configured to generate the second local signals having a variable frequency.

13. The active array antenna system according to claim 3, further comprising:

a gain control circuit configured to control a gain of each of the second intermediate-frequency signals.

14. The active array antenna system according to claim 3, wherein an input frequency band $F_{in}(\min)$ to $F_{in}(\max)$ of each of said second frequency converting circuits and frequency $F_{LO}$ of the second local signals satisfy the conditions that $F_{LO}<F_{in}(\min)/2$ and $F_{LO}<(F_{in}(\min)/(n+1))$ or $F_{LO}>(F_{in}(\max)/(n+1))$ regarding to all integers n which are not smaller than two.

15. An active array antenna system comprising:

a plurality of element antennas configured to receive carrier-wave frequency signals; and radio frequency circuits connected to the plural element antennas and comprising frequency converting circuits provided for each of said element antennas and configured to perform a frequency conversion between the carrier-wave frequency signals and intermediate-frequency signals by using local signals, and a variable phase shifter circuit provided for each of said element antennas and configured to shift phases of each of the local signals, the variable phase shifter circuit having a quadrature modulator.

16. An active array antenna system comprising:

a plurality of transmission/reception element antennas configured to transmit/receive carrier-wave frequency signals;

a reception radio frequency circuit supplied with received carrier-wave frequency signals from said transmission/reception element antennas; and a transmission radio frequency circuit configured to supply transmission carrier-wave frequency signals to said transmission/reception element antennas, wherein each of said transmission radio frequency circuit and said reception radio frequency circuit comprises:

first frequency converting circuits provided for each of said transmission/reception element antennas and configured to perform a frequency conversion between the carrier-wave frequency signals and first intermediate-frequency signals by using first local signals, second frequency converting circuits provided for each of said transmission/reception element antennas and configured to perform a frequency conversion between the first intermediate-frequency signals and second intermediate-frequency signals by using second local signals, and a variable phase shifter circuit configured to shift phases of the second local signals.

17. The active array antenna system according to claim 16, wherein said variable phase shifter circuit comprises a first variable phase shifter for said reception radio frequency circuit and a second variable phase shifter for said transmission radio frequency circuit, and the phase shift of each of said first and second variable phase shifters is controlled such that the phases of the output local signals are complex conjugates of each other, said transmission/reception element antennas comprise a plurality of transmission antennas and a plurality of reception antennas, and the same phase shift control signal is supplied to said first and second variable phase shifters corresponding to the transmission antennas and the reception antennas disposed symmetrically to each other with respect to a center of said transmission/reception element antennas.

18. An active array antenna system comprising:

element antennas configured to receive carrier-wave frequency signals; and a radio frequency circuit connected to the element antennas and comprising frequency converting circuits provided for each of said element antennas and configured to perform a frequency conversion between the carrier-wave frequency signals and intermediate-frequency signals by using local signals, and a variable phase shifter circuit configured to shift phases of the local signals, wherein said variable phase shifter circuit comprises two bridge circuits configured to receive the local signals in the form of a differential signal and having two capacitors disposed on two opposite sides and two resistors disposed on other two opposite sides, resistance values of the capacitors and the resistors being different from one another, and a selector configured to selectively output either output of the two bridge circuits in response to a phase shift control signal.

* * * * *